US011448061B1

(12) United States Patent
Alghazali et al.

(10) Patent No.: US 11,448,061 B1
(45) Date of Patent: Sep. 20, 2022

(54) MONITORING DOWNHOLE LEAKS

(71) Applicant: Saudi Arabian Oil Company, Dhahran (SA)

(72) Inventors: Mohieddin Attig Ali Alghazali, Udhailiyah (SA); Ibrahim Elsayed Ibrahim Salem, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/192,138

(22) Filed: Mar. 4, 2021

(51) Int. Cl.
*E21B 47/117* (2012.01)

(52) U.S. Cl.
CPC ..... *E21B 47/117* (2020.05)

(58) Field of Classification Search
CPC ..... E21B 47/117
See application file for complete search history.

(56) References Cited

U.S. PATENT DOCUMENTS

| | | | | |
|---|---|---|---|---|
| 5,366,017 | A | 11/1994 | Voss, Jr. | |
| 6,464,004 | B1 | 10/2002 | Crawford et al. | |
| 2004/0043501 | A1 | 3/2004 | Mean et al. | |
| 2005/0194184 | A1* | 9/2005 | Gleitman | E21B 47/04 175/45 |
| 2007/0114033 | A1* | 5/2007 | Hermes | C09K 8/42 166/371 |
| 2009/0272530 | A1* | 11/2009 | Duguid | E21B 49/10 166/250.01 |
| 2013/0087388 | A1* | 4/2013 | Veeningen | E21B 47/06 175/48 |
| 2017/0350234 | A1* | 12/2017 | Xia | E21B 47/06 |

(Continued)

FOREIGN PATENT DOCUMENTS

| | | |
|---|---|---|
| CN | 106761568 | 3/2019 |
| WO | 2009135172 | 11/2009 |

OTHER PUBLICATIONS

Pioneerps.com [online], PPS27"Permanent Downhole Monitoring Systems" Aug. 2018, [retrieved on May 13, 2021], retrieved from: URL <http://www.pioneerps.com/Pdfs/PPS27-PDMS-English-Brochure-V5.pdf>, 8 pages.

(Continued)

*Primary Examiner* — Taras P Bemko
(74) *Attorney, Agent, or Firm* — Fish & Richardson P.C.

(57) ABSTRACT

Some methods of determining a tubing and casing annulus fluid leak of a well include receiving pressure information and depth information from three or more pressure sensors in fluid communication with a fluid of the tubing casing annulus. Some methods include receiving at least three baseline pressure gradients and determining at least three current pressure gradients based on the pressure information and depth information of the three or more pressure sensors. Some methods include determining pressure differences between the at least three baseline pressure gradients and the at least three current pressure gradients. Some methods include determining whether any of the pressure differences are above a pressure threshold, and responsive to determining that at least one of the pressure differences is above the pressure threshold, determining a fluid level of the fluid within the tubing casing annulus based on the pressure differences.

20 Claims, 14 Drawing Sheets

(56) References Cited

U.S. PATENT DOCUMENTS

| | | | | |
|---|---|---|---|---|
| 2021/0040817 | A1* | 2/2021 | Ross | E21B 47/14 |
| 2021/0156244 | A1* | 5/2021 | Hoeie | E21B 47/117 |

OTHER PUBLICATIONS

Signal-fire.com [online], "Monitoring Wellhead Tubing and Casing Pressures Simplified with SignalFire Pressure Scout" Apr. 2018, [retrieved on May 13, 2021], retrieved from: URL <https://signal-fire.com/monitoring-wellhead-tubing-and-casing-pressures-simplified-with-signalfire-pressure-scout/>, 2 pages.

Slb.com [online], "Schlumberger—Metris Eclipse B-annulus PT monitoring system" Oct. 2020, [retrieved on May 13, 2021], retrieved from: URL <https://www.slb.com/-/media/files/co/product-sheet/metris-eclipse-ps.ashx>, 2 pages.

PCT International Search Report and Written Opinion in International Appln. No. PCT/US2022/018468, dated Jun. 1, 2022, 15 pages.

Wu et al., "A leakage diagnosis testing model for gas wells with sustained casing pressure from offshore platform." Journal of Natural Gas Science and Engineering 55, Jul. 2018, 276-287, 12 pages.

* cited by examiner

MONITORING DOWNHOLE LEAKS

TECHNICAL FIELD

This disclosure describes systems and methods for downhole monitoring systems and, more particularly, a downhole monitoring system for monitoring tubing casing annulus integrity.

BACKGROUND

A tubing casing annulus is generally filled with a fluid after the well is completed. The fluid is used to balance formation pressure and can reduce or eliminate differential pressure across the packer which extends packer life and reliability. The differential pressure also provides support for production tubing and the casing which prevents collapse of tubulars and can extend the life of the well.

In some cases, the fluid leaks out of the tubing casing annulus and needs to be refilled. For example, during the life of the well, several fluid refill operations might be performed which require several barrels of fluid each to fill up the tubing casing annulus. This can be expensive and time consuming.

SUMMARY

The systems and methods described in this disclosure related to downhole monitoring systems for monitoring an integrity of a tubing casing annulus of the well. In some cases, the downhole monitoring system is a dual sensor permanent downhole monitoring system to measure the annulus pressure in order to monitor the tubing casing annulus integrity and to detect tubing, casing, and packer leaks continuously over time. Tubing casing annulus integrity is an integral part of the well integrity as a whole and an intact (for example, a sealed) tubing casing annulus is important to protect shallow fresh water aquifers from reservoir fluid of the well. Historically, one approach to determine an integrity of the tubing casing annulus of a well is to fill the tubing casing annulus with inhibited diesel and check whether the fluid level decreases over time. A decrease over time may be indicative of a leak within the tubing casing annulus. However, if the integrity was known ahead of time (e.g., via a downhole monitoring system), then the refilling operation would have been unnecessary.

In another example, the tubing casing annulus may need to be refilled when the pressure within the tubing casing annulus drops to zero. For example, the pressure reduces to zero in most cases once the wells are shut-in (for example, for non-active wells). On the other hand, when the well is a flowing condition, the fluid within the tubing casing annulus can expand (for example, due to temperature rises), which increase the tubing casing annulus pressure. In this case, the downhole monitoring system monitors the integrity of the well based on whether the well is in a flowing condition or a shut-in condition and uses information about the temperature of the fluid to determine the tubing casing annulus integrity. For example, the downhole monitoring system determines when a tubing casing annulus refilling is necessary based on pressure testing objectives and reduces unnecessary refilling operations. This reduces operational costs during the life cycle of the well.

Systems and methods of determining a tubing and casing annulus fluid leak of a well can include receiving pressure information and depth information from three or more pressure sensors in fluid communication with a fluid of the tubing casing annulus; receiving at least three baseline pressure gradients; determining at least three current pressure gradients based on the pressure information and depth information of the three or more pressure sensors; determining pressure differences between the at least three baseline pressure gradients and the at least three current pressure gradients; and determining whether any of the pressure differences are above a pressure threshold, and responsive to determining that at least one of the pressure differences is above the pressure threshold, determining a fluid level of the fluid within the tubing casing annulus based on the pressure differences.

Implementations of these systems and methods can include one or more of the following features.

In some implementations, the method includes refilling the fluid within the tubing casing annulus using a pump of the well when the fluid level is below a threshold.

In some implementations, the method includes receiving temperature information and depth information from three or more temperature sensors in fluid communication with the fluid of the tubing casing annulus.

In some implementations, the three or more temperature sensors are each collocated with the at least three pressure sensors. In some cases, the method includes determining at least three current temperature gradients based on the temperature information and depth information from the three or more temperature sensors. In some cases, the method includes determining temperature differences between at least three baseline temperature gradients and the at least three current temperature gradients.

In some implementations, the method includes determining the fluid level of the fluid within the tubing casing annulus includes determining which pressure differences are above the pressure threshold and which pressure differences are below the pressure threshold. In some cases, determining the fluid level of the fluid within the tubing casing annulus includes determining that the fluid level is between a first pressure sensor of the three or more pressure sensors and a second pressure sensor of the three or more pressure sensors when the pressure difference based on the first sensor and the second sensor is above the pressure threshold.

In some implementations, the method includes determining a density of the fluid within the tubing casing annulus between each pair of the three or more pressure sensors based on the pressure information and depth information of the three or more pressure sensors. In some cases, the method includes determining a fluid type of the fluid within the tubing casing annulus between each pair of the three or more pressure sensors based on the determined density of the fluid. In some cases, determining the fluid type of the fluid within the tubing casing annulus includes determining that the fluid is hydrocarbon when the determined density is above a density threshold and determining that the fluid is water and/or completion fluid when the determined density is below the density threshold.

In some implementations, the method includes determining a leak source of the tubing casing annulus. In some cases, determining the leak source includes determining whether the fluid level represents a full tubing casing annulus or a partially full tubing casing annulus.

In some implementations, determining the leak source includes determining that a tubing leak and/or a packer leak and a casing leak is occurring when the tubing casing annulus is partially full and water and/or completion fluid is determined to be present within the tubing casing annulus based on the density.

In some implementations, determining the leak source includes determining that a casing leak is occurring when the tubing casing annulus is partially full and water and/or completion fluid is determined to not be present within the tubing casing annulus based on the density.

In some implementations, determining the leak source includes determining that a tubing leak and/or packer leak and a casing leak is occurring when the tubing casing annulus is full and water and/or completion fluid is determined to be present within the tubing casing annulus based on the density. In some cases, determining the leak source includes determining that a tubing leak and/or a packer leak is occurring when the tubing casing annulus is full and water and/or completion fluid is determined to be present within the tubing casing annulus and all of the pressure differences are indicative of a pressurized annulus. In some cases, the method includes receiving results from a leak off test indicating whether the packer is leaking and determining the leak source is a packer leak or a tubing leak based on the results from the leak off test.

In some implementations, the method includes receiving an indication that the well was in a flowing condition or a shut-in condition when the baseline pressure gradients were determined.

In some implementations, receiving the at least three baseline pressure gradients includes determining the at least three baseline pressure gradients.

The systems and methods described in this specification can provide various advantages.

A downhole monitoring system continuously monitors the tubing casing annulus fluid level to detect possible integrity issues with the casing or tubing. This is important for observation wells where positive tubing casing annulus pressure cannot be maintained continuously and must be detected as soon as possible to avoid well failure. Temperature information is utilized against a baseline survey which is conducted post drilling or completing workover on the wells. In some examples, a baseline survey is conducted every 50 feet to 500 feet depending on the required detail to identify possible tubing leaks.

Significant cost savings are possible by eliminating unnecessary tubing casing annulus refilling operations. For example, downhole monitoring system data can be utilized to monitor for pressure changes in the tubing casing annulus and these changes can be identified as a source of a downhole leak or identified as expected changes to the fluid level within tubing casing annulus.

The downhole monitoring system continuously detects the loss of tubing casing annulus integrity via sensing and transmitting the pressure and temperature changes in the tubing casing annulus.

The details of one or more embodiments of these systems and methods are set forth in the accompanying drawings and the description below. Other features, objects, and advantages of these systems and methods will be apparent from the description and drawings, and from the claims.

DESCRIPTION OF DRAWINGS

Like reference symbols in the various drawings indicate like elements.

DETAILED DESCRIPTION

The systems and methods described in this disclosure related to downhole monitoring systems for monitoring an integrity of a tubing casing annulus of the well. In some cases, the downhole monitoring system is a dual sensor permanent downhole monitoring system to measure the annulus pressure in order to monitor the tubing casing annulus integrity and to detect tubing, casing, and packer leaks continuously over time. Tubing casing annulus integrity is an integral part of the well integrity as a whole and an intact (for example, a sealed) tubing casing annulus is important to protect shallow fresh water aquifers from reservoir fluid of the well. Historically, one approach to determine an integrity of the tubing casing annulus of a well is to fill the tubing casing annulus with inhibited diesel and check whether the fluid level decreases over time. A decrease over time may be indicative of a leak within the tubing casing annulus. However, if the integrity was known ahead of time (e.g., via a downhole monitoring system), then the refilling operation would have been unnecessary.

In another example, the tubing casing annulus may need to be refilled when the pressure within the tubing casing annulus drops to zero. For example, the pressure reduces to zero in most cases once the wells are shut-in (for example, for non-active wells). On the other hand, when the well is a flowing condition, the fluid within the tubing casing annulus can expand (for example, due to temperature rises), which increase the tubing casing annulus pressure. In this case, the downhole monitoring system monitors the integrity of the well based on whether the well is in a flowing condition or a shut-in condition and uses information about the temperature of the fluid to determine the tubing casing annulus integrity. For example, the downhole monitoring system determines when a tubing casing annulus refilling is necessary based on pressure testing objectives and reduces unnecessary refilling operations. This reduces operational costs during the life cycle of the well.

Figure 1:
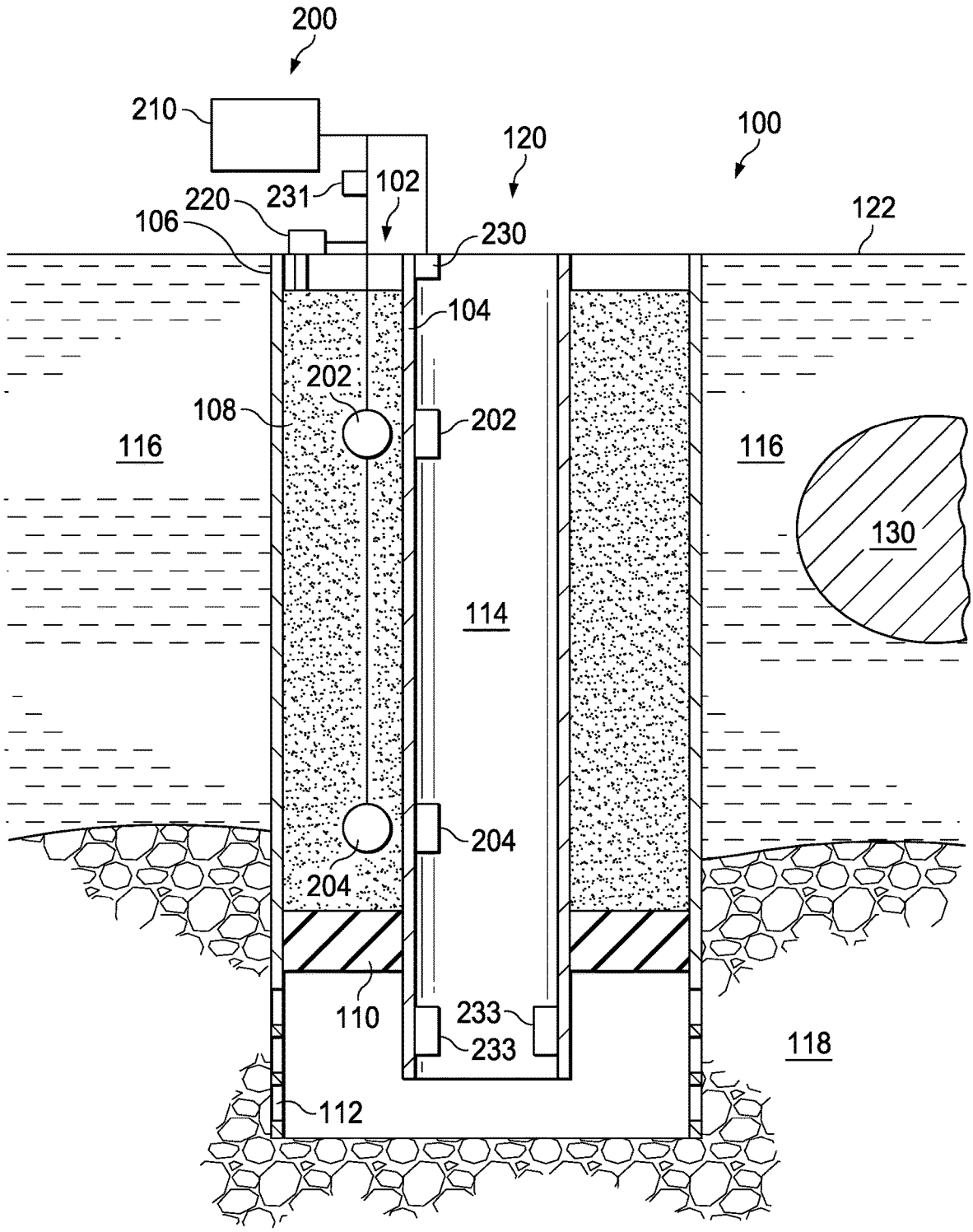
FIG. 1 is a schematic diagram of an example implementation of a downhole monitoring system for a vertical wellbore.

FIG. 1 is a schematic diagram of an example implementation of a wellbore system 100 according to the present disclosure. In some aspects, the wellbore system 100 (all or part of it) may provide a wellbore system and computational framework for monitoring the integrity of the wellbore system. In some aspects, the wellbore system 100 (and the computational framework) determines whether a fluid leak is present within the tubing casing annulus.

In some aspects, the computational framework of the wellbore system accounts for a pressure gradient between the two or more pressure sensors based on received pressure information to determine whether the fluid leak is present. The computational framework of wellbore system 100 may also account for a temperature gradient between the two or more temperature sensors based on received temperature information to determine whether the fluid leak is present. The computational framework of wellbore system 100 may also determine whether the well is in a flowing condition or a shut-in condition as part of the determination of whether the fluid leak is present.

As illustrated, the wellbore system 100 includes a wellbore 120 formed (for example, drilled or otherwise) from a ground surface 122 and to and into subterranean formation 118. Although the surface 122 is illustrated as a land surface, surface 122 may be a sub-sea or other underwater surface, such as a lake or an ocean floor or other surface under a body of water. Thus, the present disclosure contemplates that the wellbore 120 may be formed under a body of water from a drilling location on or proximate the body of water. For example, when the wellbore 120 is formed under a body of water from a drilling location on or proximate the body of water data is transmitted through fiber optic cable to the land surface.

The illustrated wellbore 120 includes a substantially vertical portion 114. As used in the present disclosure, "substantially" in the context of a wellbore orientation, refers to wellbores that may not be exactly vertical (for example, exactly perpendicular to the surface 122). In other words, those of ordinary skill in the drill arts would recognize that vertical wellbores often undulate offset from a true vertical direction or that they might be drilled at an angle that deviates from true vertical.

The illustrated wellbore 120 has a surface casing 106 (or production casing) positioned and set around the wellbore 120 from the surface 122 into a particular depth in the Earth. For example, the surface casing 106 may be a relatively large-diameter tubular member (or string of members) set (for example, cemented) around the wellbore 120 in a shallow formation. As used herein, "tubular" may refer to a member that has a circular cross-section, elliptical cross-section, or other shaped cross-section.

Cement is positioned (for example, pumped) around the casing 106 in an annulus between the casing 106 and the wellbore 120. The cement, for example, may secure the casing 106 through the subterranean layers 116 under the surface 122. In some aspects, the cement may be installed along the entire length of the casing 106, or the cement could be used along certain portions of the casing 106 if adequate for the particular wellbore 120. Other casings, such as conductor casings or intermediate casings, are also contemplated by the present disclosure for the wellbore system 100.

As illustrated, the wellbore 120 extends through one or more subterranean layers 116 and lands in subterranean formation 118. The subterranean formation 118, in this example, may be chosen as the landing, for example, in order to initiate completion operations and ultimately recover hydrocarbon fluids from the subterranean formation 118. In some examples, the subterranean formation 118 is composed of shale or tight sandstone. Shale, in some examples, may be source rocks that provide for hydrocarbon recovery from the subterranean formation 118.

As shown in FIG. 1, the wellbore system 100 includes one or more perforations 112 that are formed through the casing 106 and the cement. Generally, the perforations 112 may be formed by, for example, shaped explosive charges, water jetting, laser, or other conventional perforating techniques. Each perforation 112 may provide a path (or paths) for a hydraulic fracturing liquid (with or without proppant) to enter the subterranean formation 118 from the wellbore 120 in order to initiate and propagate hydraulic fractures through the subterranean formation 118.

The wellbore system 100 also includes tubing 104 (such as a production tubing) that is used to transport the recovered hydrocarbon from the subterranean formation 118 to the surface 122. An annulus 102 exists between the tubing 104 and the casing 106 and is generally referred to as the tubing casing annulus 102. The tubing casing annulus 102 is generally filled with a fluid 108 (such as a completion fluid) and a packing 110 (or production packer) is located downhole of the tubing casing annulus 102 to seal a fluid within the tubing casing annulus 102. The packing 110 serves to prevent the flow of reservoir fluid from the subterranean formation 118 into the tubing casing annulus 102 and prevent the flow of fluid 108 from the tubing casing annulus 102 into the subterranean formation 118 or the one or more subterranean layers 116 (for example, into a water reservoir 130).

The wellbore system 100 also includes a downhole monitoring system 200 for monitoring the integrity of the tubing casing annulus 102. The downhole monitoring system 200 includes three sensor assemblies 202, 204, and 231 which each include a pressure sensor and temperature sensor. Sensor assembly 231 is in fluid connection with the fluid of the tubing casing annulus 102. In this example, sensor assembly 202 is an upper sensor assembly and sensor assembly 204 is a lower sensor assembly. In this way, sensor assembly 204 is downhole of sensor assembly 202.

While downhole monitoring system 200 uses three sensor assemblies 202, 204, and 231, some downhole monitoring systems use more than the sensor assemblies (e.g., 3, 5, 10, etc.). In some examples, the sensor assemblies are located at least 100 feet apart and preferably less than 2000 feet apart. In some examples, the sensor assembles are located between 200 feet to 500 feet apart from each other. For example, in the case with 10 sensor assemblies each located 500 feet apart from each other, the total depth of the downhole monitoring system will span 5000 feet into the well from the surface 122. Having more than three sensor assemblies increases the resolution of determining the fluid level within the tubing casing annulus and the number of depth locations where the fluid type is determined. Aspects related to these features are explained in below.

The sensor assemblies 202, 204 are located within the fluid 108 of the tubing casing annulus 102. For example, initially the sensor assemblies 202, 204 are located below the fluid level of the fluid 108 (e.g., both the sensor assemblies 202, 204 are in physical contact with the fluid 108) but when leak develops it is possible for the fluid level of the fluid 108 to reduce below some of the sensor assemblies 202, 204. The pressure sensors are used to measure pressure information of the fluid 108 within the tubing casing annulus 102 and the temperature sensors are used to measure temperature information of the fluid 108 within the tubing casing annulus 102.

In some implementations, the sensor assemblies 202, 204 include dual pressure and temperature sensors for reading pressure and temperature from both sides of the tubing 104 and tubing casing annulus 102. In this scenario, part of the sensor assemblies 202, 204 are installed during well completion with connection ports in each side of the tubing wall (e.g., inside the tubing 104 and inside the tubing casing annulus 102) to measure pressure on both sides of the tubing wall. For example, part of sensor assemblies 202, 204 are installed in the fluid of the tubing casing annulus 102 and part of the sensor assemblies 202, 204 are installed on the inside tubing wall of the tubing 104. In some examples, the downhole monitoring system 200 monitors the pressure and temperature of the fluid using the part of the sensor assemblies 202, 204 located in the tubing casing annulus 102. In some examples, the downhole monitoring system 200 monitors the temperature, pressure, and flow rate of production of the well and performance of the well.

In some implementations, the sensor assemblies 202, 204 are mounted to the casing 106 or the tubing 104. In other implementations, the sensor assemblies 202, 204 float within the fluid 108 of the tubing casing annulus 102 without mounting to the tubing 104 or the casing 106. For example, the downhole monitoring system 200 determines the depth of each sensor of the sensor assemblies 202, 204 in real-time to account for the depth of the sensor in the fluid level and fluid leak calculations.

The three sensor assemblies 202, 204, and 231 are each electrically connected to a controller 210. In some examples, the controller 210 includes one or more processors and other computer components of a computer 902 described with reference to FIG. 9. Methods performed by the controller 210 are described below.

The downhole monitoring system 200 includes a flow sensor 230 for indicating whether the well is in a flowing condition or a shut-in condition. The flow sensor 230 is electrically connected to the controller 210. The flow sensor 230 measures the volumetric flow rate through the tubing 104 and transmits the volumetric flow rate to the controller 210. The controller 210 receives the measured volumetric flow rate from the flow sensor 230 and compares the volumetric flow rate with a threshold flow rate to determine if the well is in a flowing condition. For example, if the volumetric flow rate is above zero, the controller 210 determines that the well is in a flowing condition. If the volumetric flow rate is equal to zero, the controller 210 determines that the well is in a shut-in condition.

The downhole monitoring system 200 includes a pump 220 for refilling the tubing casing annulus 102 with fluid 108 (such as inhibited diesel) when a fluid level of the fluid 108 within the tubing casing annulus 102 is below a threshold. The pump 220 is electrically connected to the controller 210. In some examples, if the controller 210 detects that the fluid level drops below a threshold, the controller 210 controls the pump 220 to top off the fluid level. However, if the controller 210 detects that the fluid level continues dropping then the controller 210 determines that a downhole leak is present.

Figure 2:
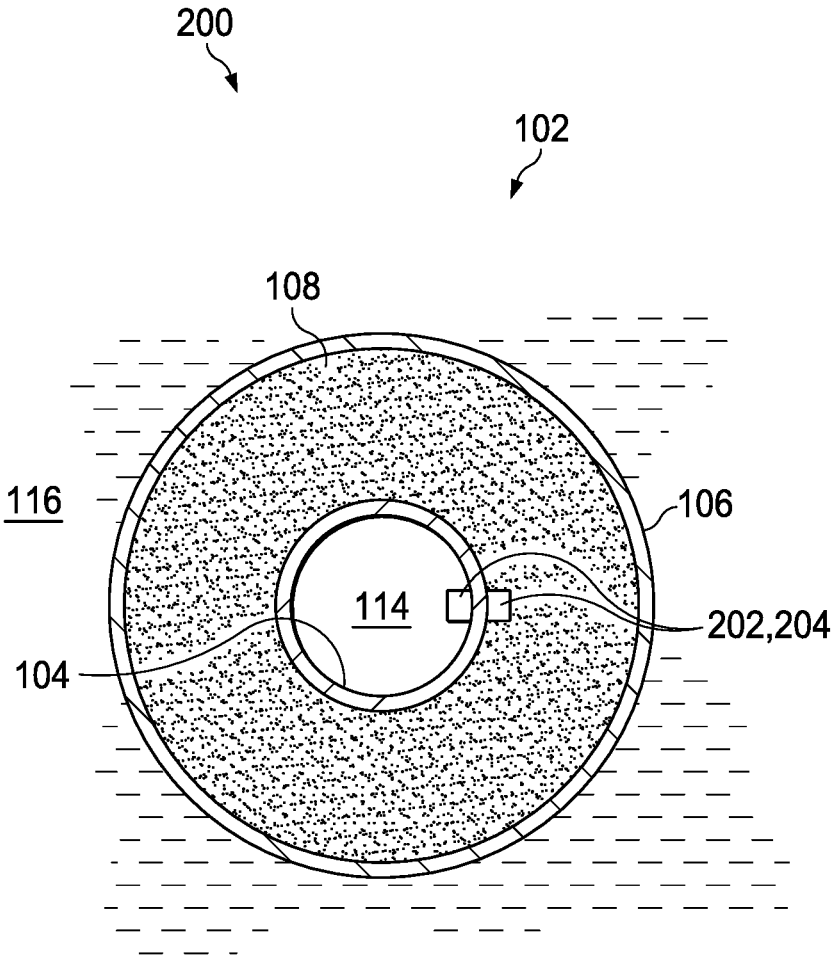
FIG. 2 is a schematic cross-section of a vertical wellbore with a tubing casing annulus.

FIG. 2 is a schematic cross-section of the wellbore system 100. In downhole monitoring system 200, the two sensor assemblies 202, 204 are located on the outside circumference of the tubing 104 inside the tubing casing annulus 102 even though one is explicitly shown in FIG. 2. One is shown because both two sensor assemblies 202, 204 are located along the same circumferential position around the tubing circumference but at different depths along the tubing. In some downhole monitoring systems, the two sensor assemblies 202, 204 are located at different circumferential positions around the circumference of the tubing 104.

Figure 3:
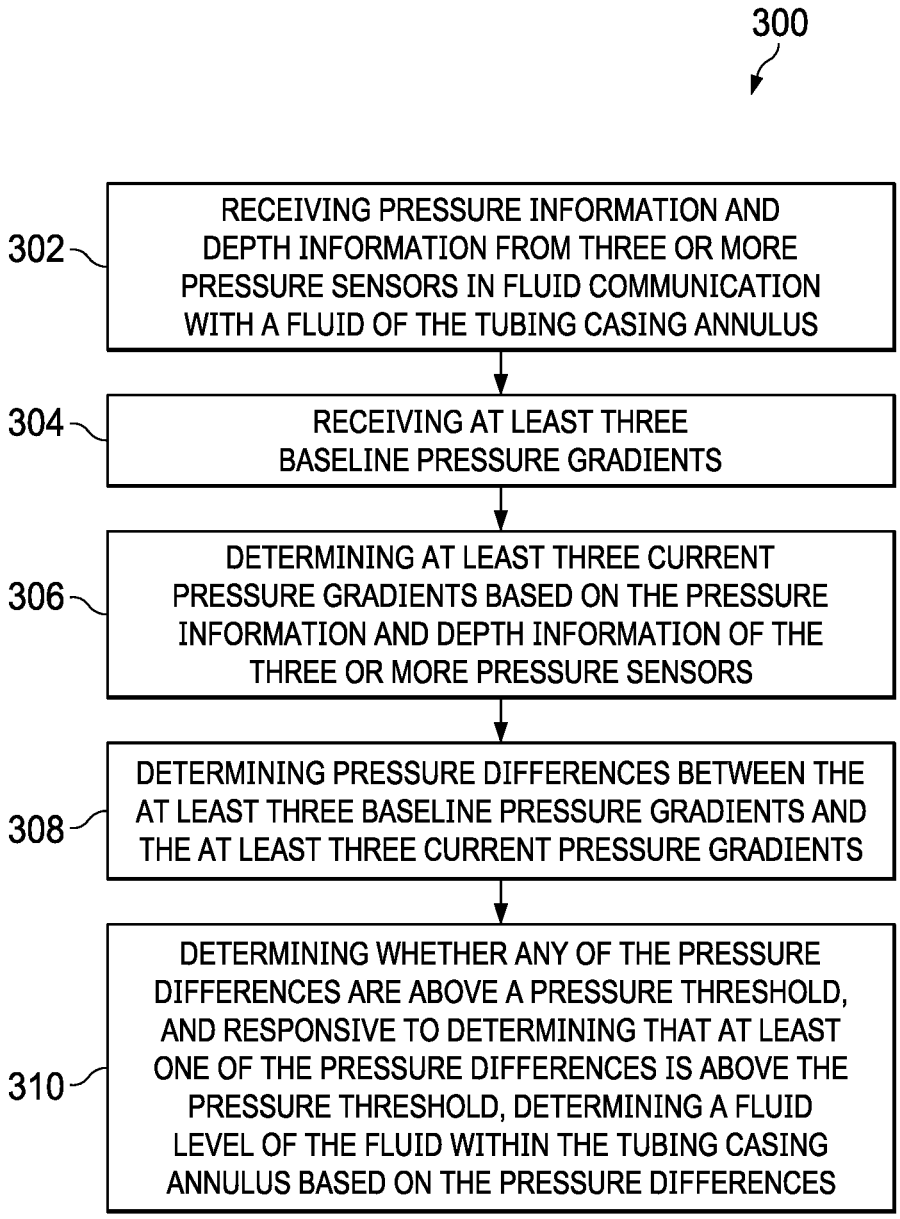
FIG. 3 is a flowchart of a method for monitoring of a tubing casing annulus for leaks.

FIG. 3 is a flowchart of a computer-implemented method 300 for monitoring of a tubing casing annulus for leaks. For example, in some cases, the method 300 is performed by the controller 210 of the downhole monitoring system 200.

The method 300 includes receiving pressure information and depth information from three or more pressure sensors in fluid communication with a fluid of the tubing casing annulus at step 302. For example, the controller 210 receives pressure information about the fluid 108 from each pressure sensor of the three or more sensor assemblies 202, 204, 231.

In some implementations, method 300 continues to step 304 by receiving at least three baseline pressure gradients. In some implementations, receiving the at least three baseline pressure gradients includes determining the at least three baseline pressure gradients.

Figure 4A:
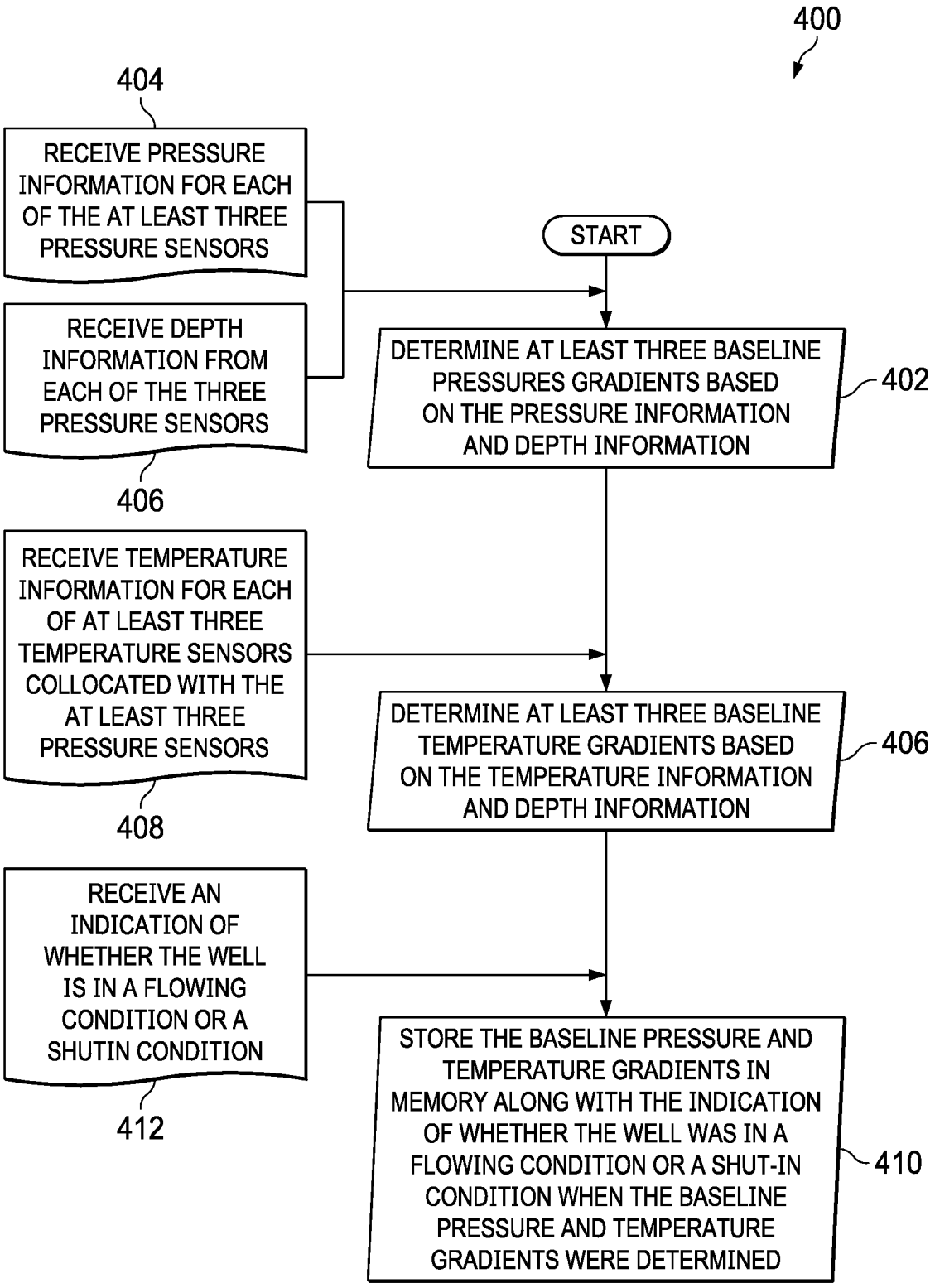
FIGS. 4A-4F are flowcharts of a decision process 400 for a downhole monitoring system.
Figure 4B:
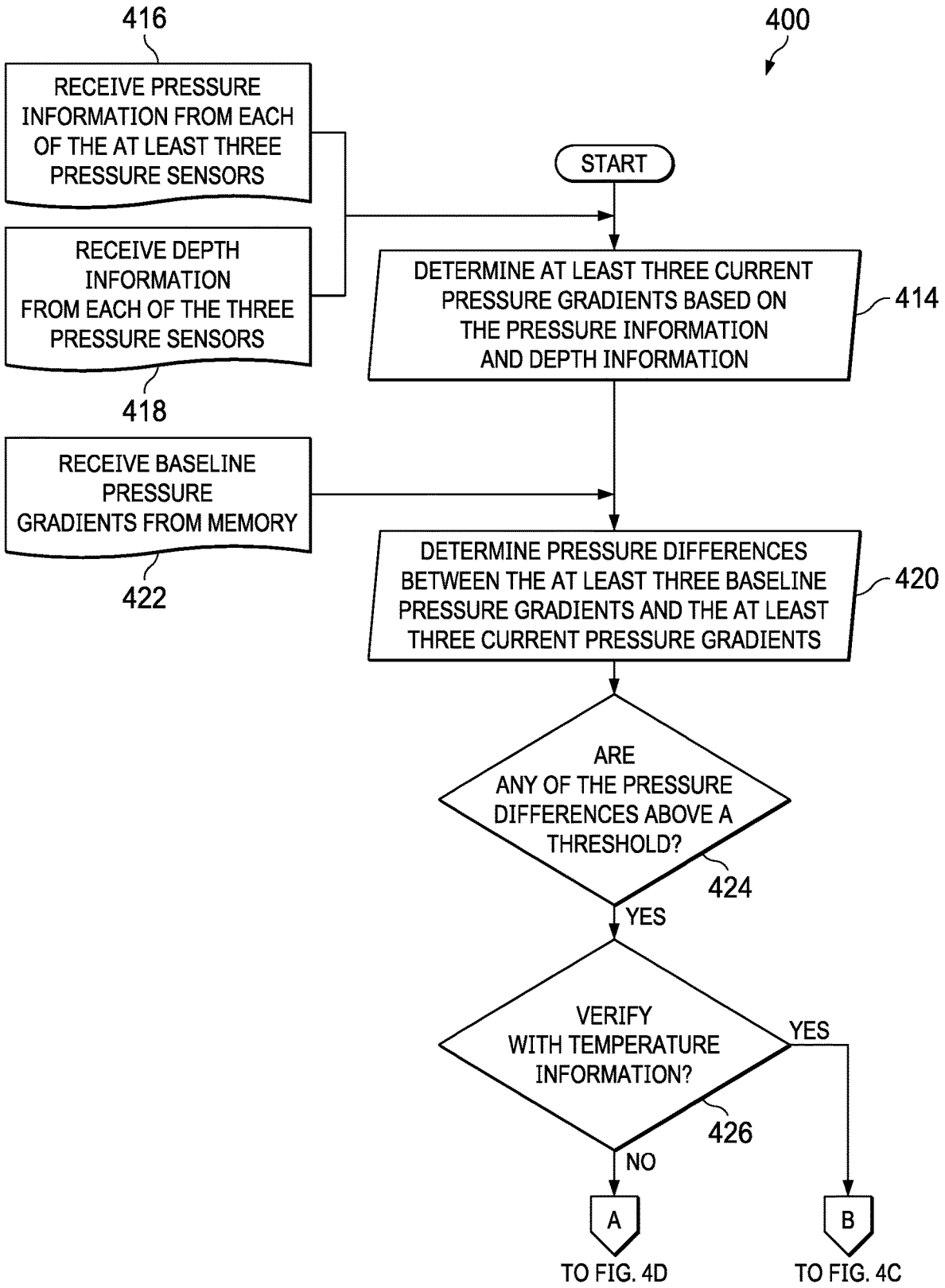
Figure 4C:
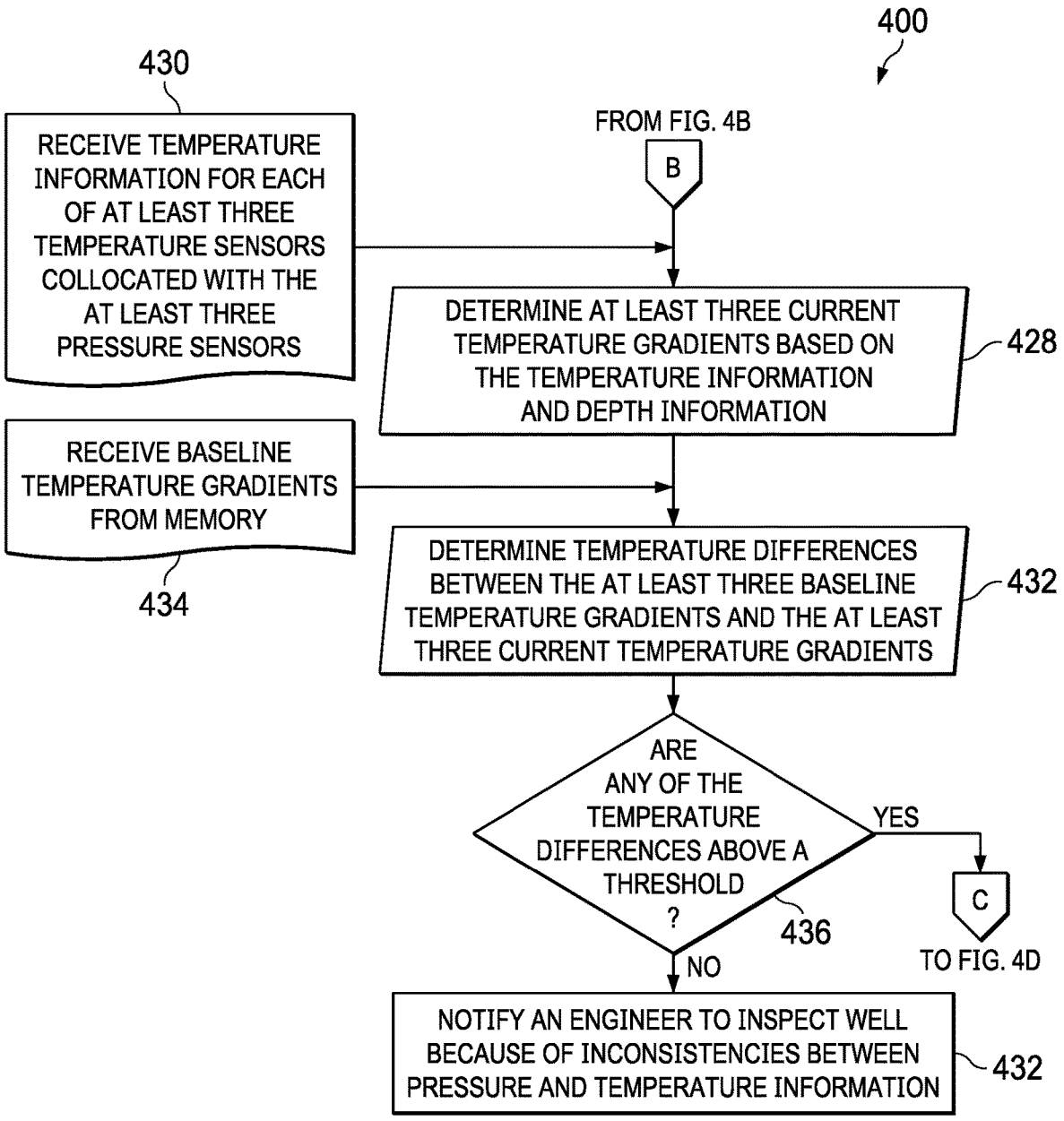

FIGS. 4A-4F are flowcharts of a decision process 400 for a downhole monitoring system. The flowchart shown in FIG. 4A represents the steps to determine baseline temperature gradients and baseline pressure gradients. The process 400 includes step 402 to determine at least three baseline pressures gradients based on the pressure information and depth information. For example, step 402 involves determining the following three baseline pressure gradients:

$$\text{Baseline Pressure Gradient 1}=(P_{231}-P_{202})/D_{202},$$

$$\text{Baseline Pressure Gradient 2}=(P_{231}-P_{204})/D_{204}, \text{ and}$$

$$\text{Baseline Pressure Gradient 3}=(P_{202}-P_{204})/(D_{202}-D_{204}).$$

The pressure information at pressure sensors 202, 204, and 231 is denoted by $P_{202}$, $P_{204}$, and $P_{231}$, respectfully and the depth information at pressure sensors 202, 204, and 231 is denoted by $D_{202}$, $D_{204}$, and $D_{231}$, respectfully. In this scenario, the pressure gradient is determined for each pair of sensors of the three or more pressure sensors and represents the pressure between the respective sensor pairs divided by a depth difference of the respective sensor pairs. In some examples, the pressure gradients have units of psig/ft.

In this context, "baseline" represents an initial measurement. In some examples, the baseline pressure gradients are determined a day or a month before the current measurements explained below. As part of this determination, the downhole monitor system receives pressure information for each of the at least three pressure sensors 202, 204, and 231 (step 404) and receives depth information from each of the three pressure sensors 202, 204, and 231 (step 406).

In some examples, the pressure information represents a range of pressure between atmospheric pressure and a pressure above atmospheric pressure. In some examples, the pressure information is in gauge pressure relative to atmospheric pressure (for example, units of psig). In some implementations, the process includes receiving an indication that the well was in a flowing condition or a shut-in condition when the baseline pressure gradients were determined.

In some examples, the controller 210 receives pressure and depth information from each of the two sensor assemblies 202, 204 directly (for example, automatically as part of the signals received). In some examples, the depth information is input into the controller 210 directly (for example, from an engineer when installing the downhole monitoring system 200 using an interface of the controller 210). In some examples, the depth information is in units of feet below the surface 122.

In some implementations, the process includes receiving packing depth information and tubing casing annulus volume. In some examples, packing depth information and tubing casing annulus volume (or capacity) is input into the interface of the controller 210 by an engineer and stored in a database (e.g., a hard drive of the controller 210). In some cases, tubing casing annulus volume is determined by the controller 210 based on the following equation:

$$V = \frac{\pi L}{4}(ID^2 - OD^2)$$

where L is the axial length of the tubing casing annulus (for example, the depth of the tubing casing annulus), ID is the internal diameter of the casing, and OD is the outside diameter of the tubing. V represents the total volume for the tubing casing annulus that can be filled with fluid. In this scenario, geometric parameters L, ID, and OD are input into the controller 210 and the controller 210 determines V based on the geometric parameters. The tubing casing annulus volume is stored in memory and used by the downhole monitoring system to determine how much fluid is required to fill the tubing casing annulus via the pump 220.

In some implementations, the process 400 continues to step 406 to determine at least three baseline temperature gradients based on the temperature information and depth information. For example, step 406 involves determining the following three baseline temperature gradients:

$$\text{Baseline Temperature Gradient 1}=(T_{231}-T_{202})/D_{202},$$

$$\text{Baseline Temperature Gradient 2}=(T_{231}-T_{204})/D_{204}, \text{ and}$$

$$\text{Baseline Temperature Gradient 3}=(T_{202}-T_{204})/(D_{202}-D_{204}).$$

The temperature information at temperature sensors 202, 204, and 231 is denoted by $T_{202}$, $T_{204}$, and $T_{231}$, respectfully and the depth information at temperature sensors 202, 204, and 231 is denoted by $D_{202}$, $D_{204}$, and $D_{231}$, respectfully. As part of this determination, the downhole monitor system receives temperature information for each of the at least three temperature sensors 202, 204, and 231 (step 408). In cases where the pressure sensors are collocated with the temperature sensors the depth information between the pressure sensors and the temperature sensors are the same. In some examples, the temperature information represents a range of temperatures between 0° F. and 250° F. In other examples, the temperature information represents a range of temperatures between 0° F. and 350° F.

In some cases, the baseline temperature gradients are geothermal temperature gradients. In some examples, changes in the geothermal gradient are determined based on measurements of a time period. For example, the controller 210 determines changes in the geothermal gradient over a day or over a week.

In some implementations, the process 400 continues to step 410 to store the baseline pressure and temperature gradients in memory. In some cases, the downhole monitoring system receives an indication of whether the well is in a flowing condition or a shut-in condition at step 412. For example, the controller 210 receives a volumetric flow rate from the flow sensor 230 and determines that the wellbore system 100 is in a flowing condition when the volumetric flow rate is above a flow rate threshold. In some examples, the controller 210 determines that the wellbore system 100 is in a shut-in condition when the volumetric flow rate is below the flow rate threshold. In this case, step 410 includes storing the indication of whether the well was in a flowing condition or a shut-in condition when the baseline pressure and temperature gradients were determined.

Referring back to FIG. 3, the method 300 continues to step 306 by determining at least three current pressure gradients based on the pressure information and depth information of the three or more pressure sensors. This step is also denoted as step 414 of process 400 shown in FIG. 4B. For example, step 414 involves determining the following three current pressure gradients:

$$\text{Current Pressure Gradient 1}=(P_{231}-P_{202})/D_{202},$$

$$\text{Current Pressure Gradient 2}=(P_{231}-P_{204})/D_{204}, \text{ and}$$

$$\text{Current Pressure Gradient 3}=(P_{202}-P_{204})/(D_{202}-D_{204}).$$

The pressure information at pressure sensors 202, 204, and 231 is denoted by $P_{202}$, $P_{204}$, and $P_{231}$, respectfully and the depth information at pressure sensors 202, 204, and 231 is denoted by $D_{202}$, $D_{204}$, and $D_{231}$, respectfully. In this way, the current pressure gradient is computed in the same way as the baseline pressure gradient but the current pressure gradient is determined at a time after the baseline pressure gradient is determined. The pressure information is also received from each of the at least three pressure sensors (step 416) and the depth information is also received from each of the three pressure sensors (step 418).

Referring back to FIG. 3, the method 300 continues to step 308 by determining pressure differences between the at least three baseline pressure gradients and the at least three current pressure gradients. This step is also denoted as step 420 of process 400 shown in FIG. 4B. For example, step 420 involves determining the following three pressure gradient differences:

Press. Gradient Difference 1=Current Press. Gradient 1−Baseline Press. Gradient 1, Press. Gradient Difference 2=Current Press. Gradient 2−Baseline Press. Gradient 2, and Press. Gradient Difference 3=Current Press. Gradient 3−Baseline Press. Gradient 3.

The process 400 includes step 422 by receiving the baseline pressure gradients from memory.

Referring back to FIG. 3, the method 300 continues to step 310 by determining whether any of the pressure differences are above a pressure threshold. This step is also denoted as step 424 of process 400 shown in FIG. 4B. For example, step 424 involves determining whether any of the following conditions are satisfied:

Is abs(Pressure Gradient Difference 1)>=Pressure Difference Threshold,

Is abs(Pressure Gradient Difference 2)>=Pressure Difference Threshold, and

Is abs(Pressure Gradient Difference 3)>=Pressure Difference Threshold.

Where "abs" represents an absolute value of the term within parenthesis. In some examples, Pressure Difference Threshold is set to zero. In other examples, it is set to 100 psig or another pressure threshold. If process 400 determines that none of the above conditions are satisfied, the process determines that there are no changes to the fluid within the tubing casing annulus and a leak is unlikely. If process 400 determines that at least one of the above conditions are satisfied, the process continues to step 426 where the process determines whether verification with temperature information is requested. In some examples, temperature information is used to provide a second indication that an issue exists within the well.

In the case where verification with temperature is requested at step 426 (for example, by a user), the process continues to step 428 to determine at least three current temperature gradients based on the temperature information and depth information. In this example, the downhole monitoring system receives temperature information and depth information from three or more temperature sensors 202, 204, and 231 in fluid communication with the fluid of the tubing casing annulus (step 430). In some examples, the at least three temperature sensors are collocated with the at least three pressure sensors 202, 204, 231

The downhole monitoring system determines at least three current temperature gradients based on the temperature information and depth information from the at least three temperature sensors. For example, step 428 involves determining the following three current temperature gradients:

Current Temperature Gradient 1=$(T_{231}-T_{202})/D_{202}$,

Current Temperature Gradient 2=$(T_{231}-T_{204})/D_{204}$, and

Current Temperature Gradient 3=$(T_{202}-T_{204})/(D_{202}-D_{204})$.

The temperature information at temperature sensors 202, 204, and 231 is denoted by $T_{202}$, $T_{204}$, and $T_{231}$, respectfully and the depth information at temperature sensors 202, 204, and 231 is denoted by $D_{202}$, $D_{204}$, and $D_{231}$, respectfully.

The process 400 continues to step 432 to determine temperature differences between the at least three baseline temperature gradients and the at least three current temperature gradients. For example, step 432 involves determining the following three temperature gradient differences:

Temp. Gradient Difference 1=Current Temp. Gradient 1−Baseline Temp. Gradient 1,

Temp. Gradient Difference 2=Current Temp. Gradient 2−Baseline Temp. Gradient 2, and Temp. Gradient Difference 3=Current Temp. Gradient 3−Baseline Temp. Gradient 3.

The process 400 includes step 434 by receiving the baseline temperature gradients from memory. The process 400 continues to step 436 by determining whether any of the temperature differences are above a temperature threshold. For example, step 436 involves determining whether any of the following conditions are satisfied:

Is abs(Temperature Gradient Difference 1)>=Temperature Difference Threshold,

Is abs(Temperature Gradient Difference 2)>=Temperature Difference Threshold, and Is abs(Temperature Gradient Difference 3)>=Temperature Difference Threshold.

In some examples, Temperature Difference Threshold is set to zero. In other examples, it is set to 10 degrees Fahrenheit or another temperature threshold. In some implementations, the downhole monitoring system determines that the above conditions are satisfied when the downhole monitoring system determines a temperature gradient of greater than 0.016° F./1000 ft.

If process 400 determines that none of the above conditions are satisfied, the process determines that there are contradicting indications of a leak (for example, the pressure gradients indicated a possible leak but the temperature gradients did not). In this scenario, the downhole monitoring system proceeds to step 438 to provide a notification to an engineer (for example, via a display as part of a mobile device). In some examples, the notification notifies an engineer that there are inconsistent leak indications between pressure and temperature information and that the engineer should attend to the well to double check.

Figure 4D:
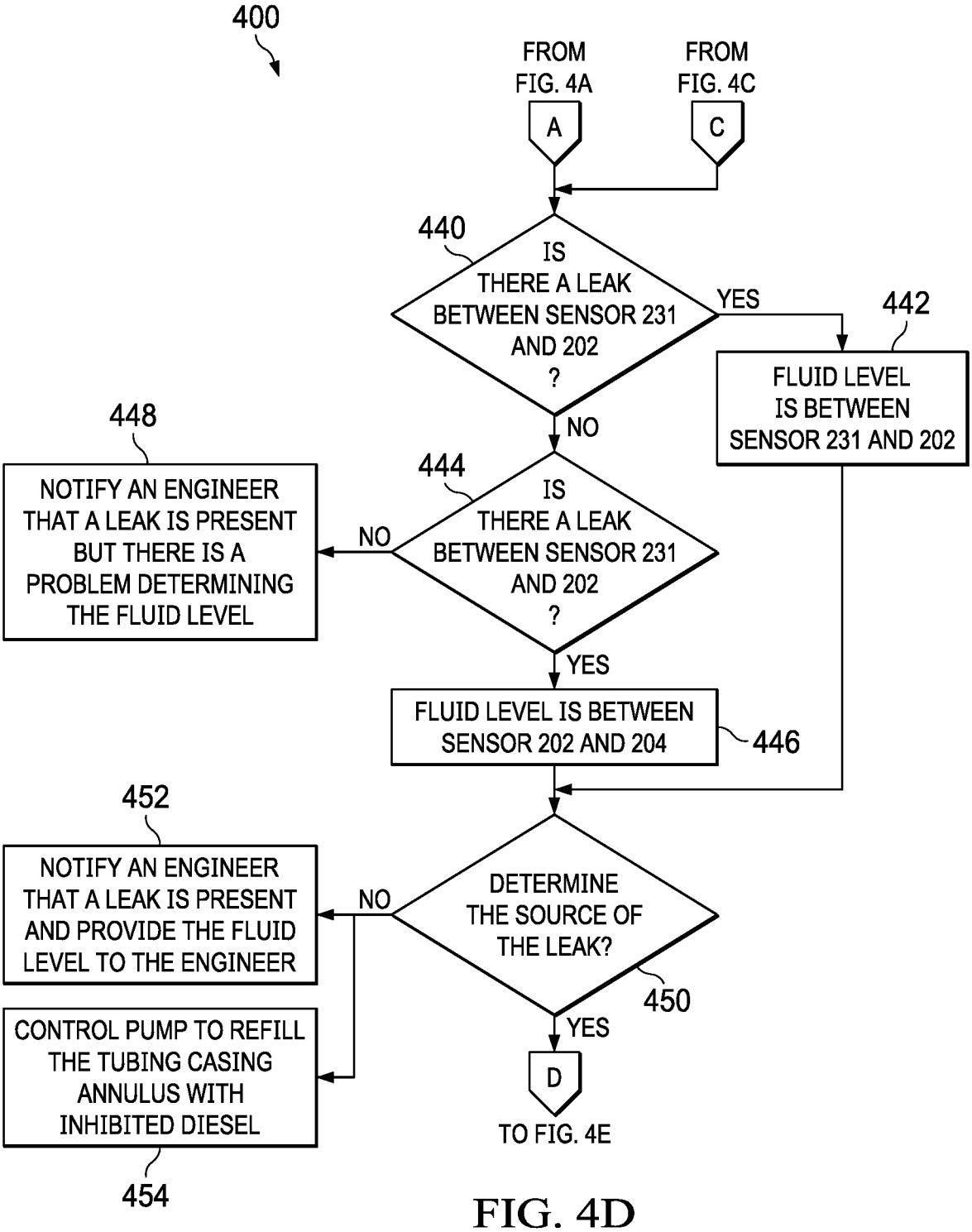

If process 400 determines that at least one of the above conditions are satisfied, the process proceeds to determine the fluid level of the fluid as shown in FIG. 4D. Referring back to FIG. 3, step 310 includes, responsive to determining that at least one of the pressure differences is above the pressure threshold, determining a fluid level of the fluid within the tubing casing annulus based on the pressure differences. For example, during a fluid leak event, the initial fluid level decreases to the location where the leak is occurring, but the fluid level does not decrease below the location where the leak is occurring. In this example, the controller 210 determines the depth of the fluid leak as the depth location where the fluid level reaches a steady state (for example, when the fluid level remains constant for a specific time period such as one minute or one hour).

In some implementations, determining the fluid level of the fluid within the tubing casing annulus includes determining that the fluid level is between a first pressure sensor of the three or more pressure sensors and a second pressure sensor of the three or more pressure sensors when the pressure difference based on the first sensor and the second sensor is above the pressure threshold. For example, determining the fluid level of the fluid within the tubing casing annulus includes step 440 to determine which pressure differences are above the pressure threshold and which pressure differences are below the pressure threshold. For example, step 440 involves determining if all of the following conditions are satisfied:

Is Pressure Gradient Difference 1>=Pressure Difference Threshold, and

Is Pressure Gradient Difference 3<Pressure Difference Threshold.

If the above conditions are satisfied, the downhole monitoring system determines that the fluid level is between the sensors 202 and 231 (step 442). This is because Pressure Gradient Difference 1 represents the pressure different between sensors 202 and 231 and a change in pressure gradient indicates that at least a portion of the depth between sensors 202 and 231 contains no fluid. On the other hand, a small change in pressure gradient (or no change at all) indicates that the depth between the sensors contains fluid since (assuming this depth was submerged in fluid during the baseline pressure measurements). In this example, Pressure Gradient Difference 2 is not explicitly included in the above conditions because Pressure Gradient Difference 2 spans the entire depth of the well between the surface of the well to the sensor 204 and instead Pressure Gradient Difference 1 and 3 are sufficient for determining whether the leak is between the sensors 202 and 231.

If the conditions above are not satisfied, the process continues to step 444 to determining if all of the following conditions are satisfied:

Is Pressure Gradient Difference 1>=Pressure Difference Threshold,

Is Pressure Gradient Difference 3>=Pressure Difference Threshold.

If the above conditions are satisfied, the downhole monitoring system determines that the fluid level is between the sensors 202 and 204 (step 446). This is because Pressure Gradient Difference 3 represents the pressure different between sensors 202 and 204 and a change in pressure gradient indicates that at least a portion of the depth between sensors 202 and 204 contains no fluid. Note that Pressure Gradient Difference 1 is also part checked to be above the Pressure Difference Threshold because both of these pressure differences should show a decrease in pressure if the leak is below a depth of sensor 202. This process is repeated for each pair of sensors of the at least three sensors to determine which pair of the at least three sensors the fluid level is between.

If the above conditions are not satisfied, the process 400 continues to step 448 to provide a notification to an engineer that something is wrong. The notification notifies the engineer that a leak is determined to be present but there is a problem determining the fluid level.

Once the fluid level is determined to be either between a pair of sensors of the at least three sensors, the process 400 continues to step 450 to determine if the source of the leak is requested. If the source of the leak is not requested, the process continues to step 452 to notify the engineer that a leak is present and provide the fluid level to the engineer. In some examples, the engineer takes this information and manually checks the well to confirm the conditions. In other examples, the engineer repairs the well and/or refills the well.

In some implementations, the process proceeds to step 454 to control the pump 220 to refill the tubing casing annulus with fluid (for example, inhibited diesel) when the fluid level is below a threshold. For example, if the fluid level is below sensor 202 (for example, as determined by the conditions of step 444 being true), the downhole monitoring system turns on the pump and controls the pump to pump inhibited diesel into the tubing casing annulus 102 until the fluid level is full again (for example, as determined by comparing the pressure gradients with the baseline pressure gradients during the refilling process).

Once the tubing casing annulus is determined to be full, the downhole monitoring system turns off the pump to stop the pump from pumping in more inhibited diesel than necessary. Some methods include refilling the tubing casing annulus with the fluid when the fluid level is below a threshold. In other examples, the pump 220 is used to pump fluid into the tubing casing annulus 102 when the fluid level of the fluid casing annulus drops to a point where the pressure at the surface 231 is no longer positive. In other examples, the downhole monitoring system secures the well if a leak is detected by sealing the well head.

Figure 4E:
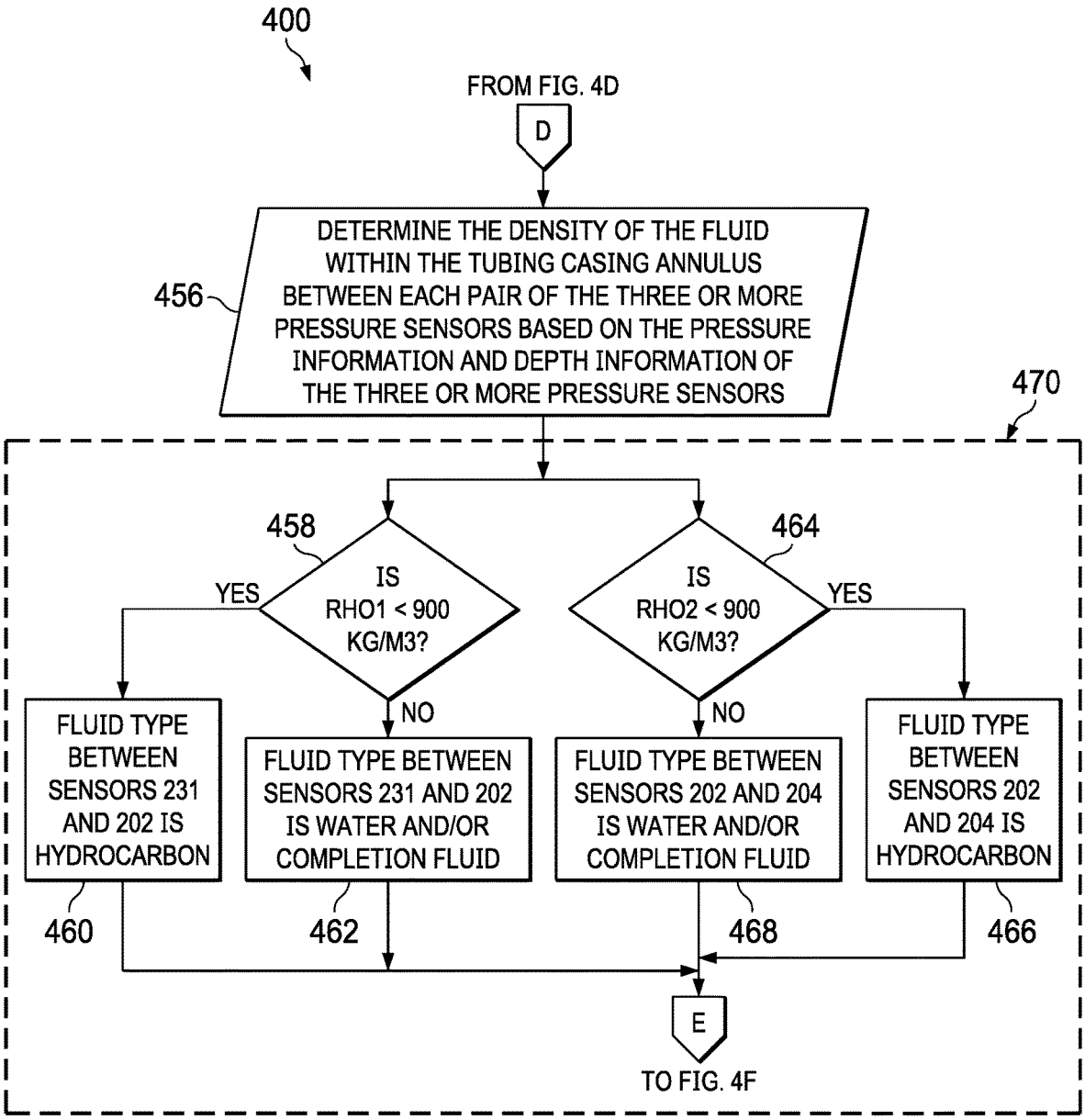

If the source of the leak is requested at step 450, the process continues to determine the source of the leak as shown in FIG. 4E. As part of the source determination, the process determines density of the fluid within the tubing casing annulus between each pair of the three or more pressure sensors based on the pressure information and depth information of the three or more pressure sensors (step 456). In some cases, the fluid density (p) determined based on the following equations:

$$\rho_1 = \frac{(P_{202} - P_{231})}{0.433 * D_{202}} \text{ and } \rho_2 = \frac{(P_{204} - P_{202})}{0.433 * (D_{204} - D_{202})}.$$

where $\rho_1$ is fluid density above the first sensor and $\rho_2$ is fluid density between the first and second sensors. In the above equations, the fluid densities are determined assuming that the fluid is an incompressible fluid such that density is directly proportional to pressure. In this scenario, as pressure increases, with temperature constant, density increases.

Once the densities are determined, the process continues to step 470 to determine a fluid type of the fluid within the tubing casing annulus between each pair of the three or more pressure sensors based on the determined density of the fluid. In some implementations, determining the fluid type of the fluid within the tubing casing annulus includes determining that the fluid is hydrocarbon when the determined density is above a density threshold and determining that the fluid is water and/or completion fluid when the determined density is below the density threshold. For example, the process includes step 458 to determine if $\rho_1 < 1$ kg/m$^3$. If true, the process continues to step 460 to conclude that the fluid type between sensor 231 and sensor 202 is hydrocarbon (for example, crude oil, inhibited diesel, and/or inhibited brine). If false, the process continues to step 462 to conclude that the fluid type between sensor 231 and sensor 202 is water and/or completion fluid. The process continues to step to 464 to determine if $\rho_2 < 900$ kg/m$^3$. If true, the process continues to step 466 to conclude that the fluid type between sensor 202 and sensor 204 is hydrocarbon. If false, the process continues to step 468 to conclude that the fluid type between sensor 202 and sensor 204 is water and/or completion fluid. This process is repeated for each pair of sensors of the at least three sensors. In this example, at 15° C. a density above 900 kg/m$^3$ is used to determine that the fluid is water and a density below 900 kg/m$^3$ is used to determine that the fluid is a hydrocarbon. In other examples, other density thresholds are used (for example, 800 kg/m$^3$, 1000 kg/m$^3$, or 1100 kg/m$^3$).

Figure 4F:
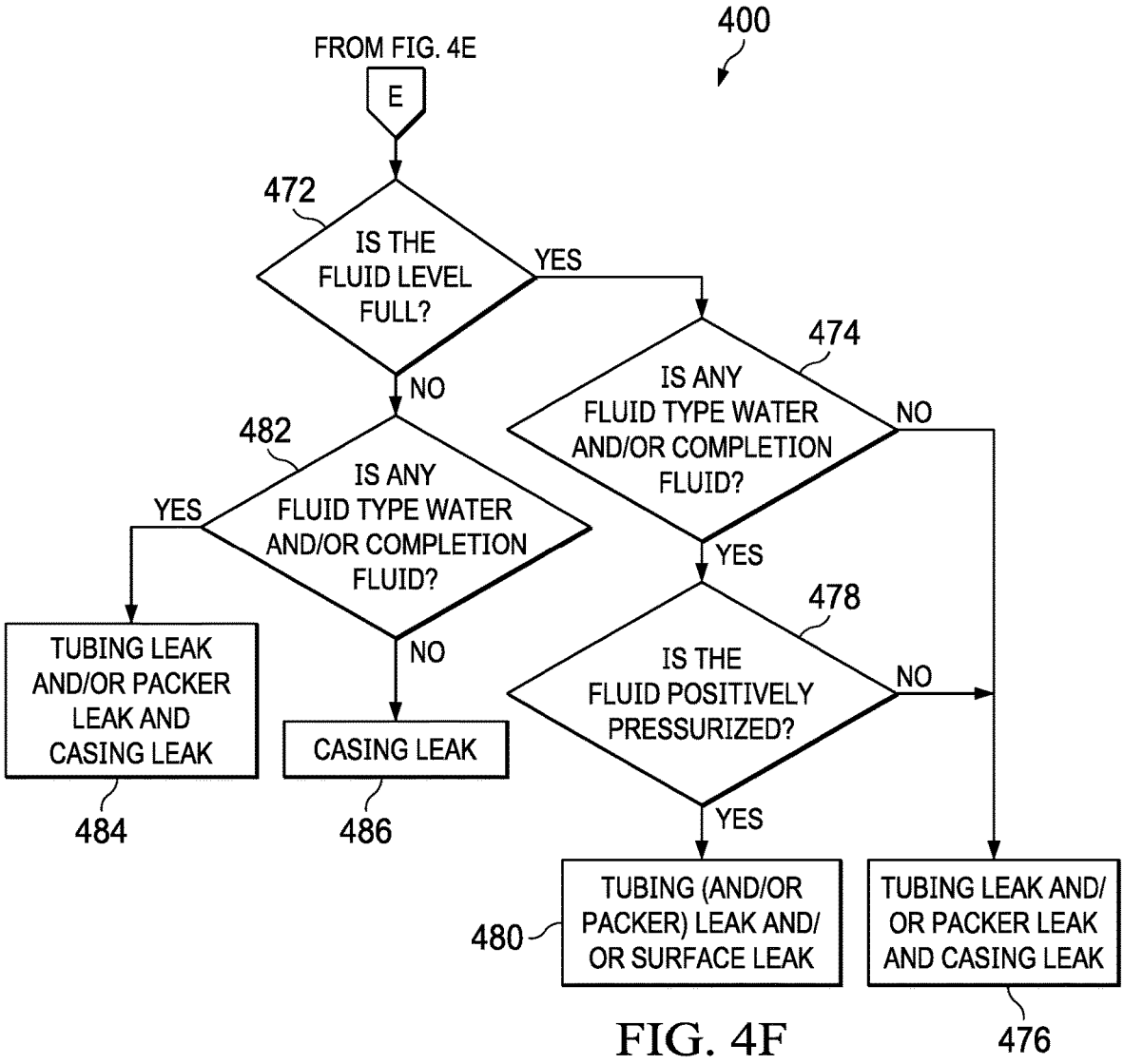

Once the fluid type is determined, the process proceeds to determine the leak source of the tubing casing annulus as shown in FIG. 4F. In some examples, determining the leak source includes determining whether the fluid level represents a full tubing casing annulus (step 472). In some cases, the fluid level is determined based on a measurement from a capacity sensor or approximated based on the pressure differences described above.

If the tubing casing annulus is full, the process continues to step 474 to determine if any of the fluid within the tubing casing annulus is water and/or completion fluid. As noted above, the tubing casing annulus is filled with a fluid such as inhibited diesel as the baseline condition. If water and/or completion fluid enters the tubing casing annulus, the downhole monitoring system will detect the different fluid through the process described above with reference to FIG. 4E. If no water and/or completion fluid is detected within the tubing casing annulus, the process proceeds to step 476 to conclude that a tubing leak and/or a packer leak and a casing leak and/or surface leak is present. In this example, the leak source is determined to be four possibilities: a tubing leak, a packer leak, a casing leak, and surface leak. In some examples, the downhole monitoring system provides a notification to the engineer that a leak is present and indicates the determined leak sources.

If the downhole monitoring system determines that the fluid type is water and/or completion fluid, the process continues to step 478 to determine if the fluid is positively pressurized. For example, determining whether the fluid is positively pressurized is based on all of the following conditions determined to be true:

Is Pressure Gradient Difference 1>Pressure Difference Threshold,

Is Pressure Gradient Difference 2>Pressure Difference Threshold, and

Is Pressure Gradient Difference 3>Pressure Difference Threshold.

If the above conditions are false, the process proceeds to step 476 as noted above. In this scenario, a full tubing casing annulus with a fluid that includes water and/or completion fluid but is not pressurized might be indicative of a multi-point leak where the water and/or completion fluid is leaking into the tubing casing annulus and, simultaneously, fluid of the tubing casing annulus is leaking out of the tubing casing annulus into the tubing and/or into the subterranean formation. The downhole monitoring system determines the leak source by determining that a tubing leak and/or packer leak and a casing leak is occurring when the tubing casing annulus is full and water and/or completion fluid is determined to be present within the tubing casing annulus based on the density.

If the fluid is determined to be pressurized, the process determines that the tubing casing annulus has a tubing and/or a packer leak (step 480). The downhole monitoring system determines the leak source by determining that a tubing leak and/or a packer leak and/or surface leak is occurring when the tubing casing annulus is full and water and/or completion fluid is determined to be present within the tubing casing annulus and all of the pressure differences are indicative of a positively pressurized annulus. In this scenario, water and/or completion fluid is leaking into the tubing casing annulus which is causing the pressure to rise at each of the pressure sensors. All of the sensors measure the higher pressure because the well is full.

In some implementations, the engineer intervenes by installing a downhole plug in the well and performing a bleed off test to determine whether the tubing and/or packer is leaking. For example, the bleed off test identifies the leak source as being either the tubing or the packer. In some examples, the engineer conducts a bleed off test after a downhole plug is installed in the x-nipple 233 as shown in FIG. 1. The x-nipple 233 is part of the downhole accessories in the tubing and is located to allow installing downhole barriers, plugs and downhole gauges to be installed in the well. The bleed off test is performed above the plug from the tubing side and the tubing and casing annulus side.

The engineer uses the results of the bleed off test to confirm that the tubing is leaking and also to confirm that the packer is leaking. In some examples, the downhole monitoring system receives the results from a bleed off test indicating whether the packer is leaking (for example, by the engineer inputting the results into a user interface) and the downhole monitoring system determines that the leak source is a packer leak based on the results from the bleed off test. The downhole monitoring system receives results from a bleed off test indicating whether the packer is leaking and determining the leak source is a packer leak or a tubing leak based on the results from the leak off test.

In some implementations, the engineer intervenes to determine a fluid flow direction of the fluid leak based on the results of the bleed off test. In some examples, the fluid direction is determined using an analytical model based on the pressure gradients and fluid level. In other examples, the fluid direction is determined by installing a PX plug in the x-nipple and performing the bleed off (as described above) above the plug from the tubing side and the tubing and casing annulus side. In some examples, an engineer intervenes by conducting a wireline operation to confirm the leak source and/or the fluid flow direction.

Referring back to step 472, if the downhole monitoring system determines that the fluid level is not full (for example, when the downhole monitoring system determines that the fluid level is partially full or empty), the process continues to step 482 to determine if any of the fluid within the tubing casing annulus is water and/or completion fluid. If the downhole monitoring system determines that water and/or completion fluid is present within the tubing casing annulus, the process concludes that a tubing and/or a packer leak and a casing leak is present (step 484). A surface leak is ruled out because a surface leak typically occurs when the tubing casing annulus is full. In this example, the downhole monitoring system determines that a tubing leak and/or a packer leak and a casing leak is occurring when the tubing casing annulus is partially full and water and/or completion fluid is determined to be present within the tubing casing annulus based on the density.

If the downhole monitoring system determines that water and/or completion fluid is not present within the tubing casing annulus, the process concludes that a casing leak is present (step 486). A tubing leak and/or a packer leak is ruled out because no water and/or completion fluid is detected within the tubing casing annulus. In this example, the downhole monitoring system determines that a casing leak is occurring when the tubing casing annulus is partially full and water and/or completion fluid is determined to not be present within the tubing casing annulus based on the density.

In some implementations, the downhole monitoring system determines a leak rate of the fluid leak based on changes to the pressure gradients over time. For example, in some cases, the leak rate is determined based on the following equation:

$$\text{Leak Rate}\left(\frac{psi}{\text{minutes}}\right) = \frac{P_T - P_{T+1}}{\Delta T}$$

where ΔT is the time increment (for example, in minutes), $P_T$ is the Pressure measurement (in psig) at the current time, and $P_{T+1}$ is the pressure measurement (psig) at a future time. The leak rate is computed for each sensor of the at least three sensors. In some examples, the leak rate is computed based on changes to the pressure gradient differences over time (such as minutes or days). For example, during a flowing condition, the well can experience high temperatures due to reservoir fluid is being transported to the surface. This change can lead to a high surface pressure in the tubing casing annulus. This increase can subsequently lead to an increase in the leak rate.

Figure 5:
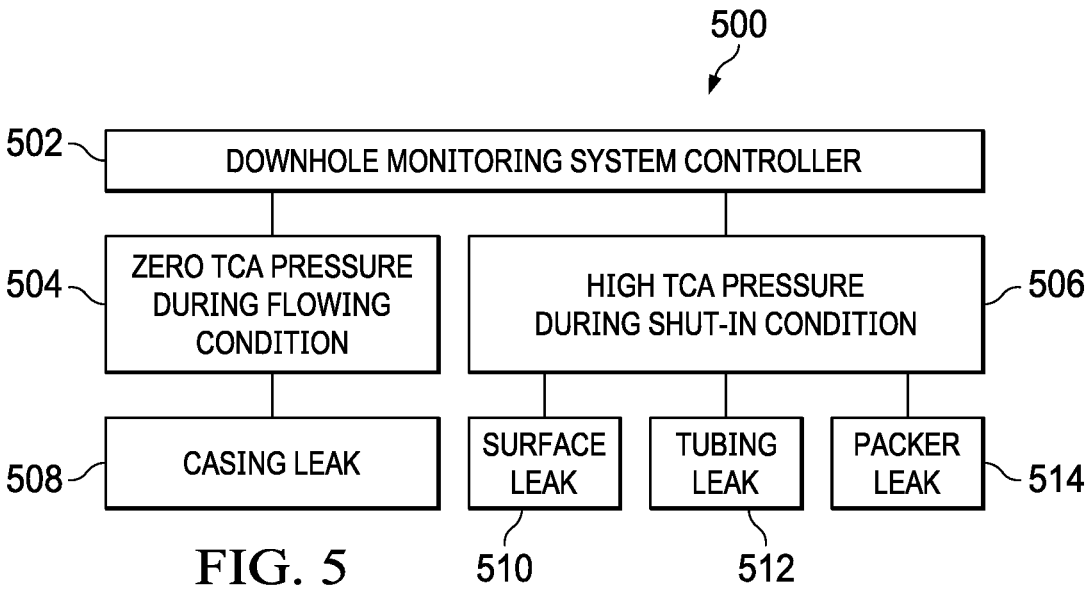
FIG. 5 is a flowchart of an additional decision process for a downhole monitoring system.

FIG. 5 is a flowchart 500 of an additional decision process for a downhole monitoring system. In some implementations, the downhole monitoring system determines that a casing leak is present when the pressure gradient differences indicate a reduction in pressure compared to the baseline pressure gradient and the well is in a flowing condition (steps 504 and 508).

In some implementations, the downhole monitoring system determines that a surface leak and/or tubing leak and/or packer leak is present when the pressure gradient differences indicate an increase in pressure compared to the baseline pressure gradient and the well is in a shut-in condition (steps 506, 510, 512, and 514). For example, a surface leak could occur as a result of faulty wellhead seals. In some examples, the downhole monitoring system detects this by detecting that the surface tubing casing annulus pressure 231 mimics the wellhead tubing flowing and shut-in pressure. The downhole monitoring system includes a controller 502 as described above, such as controller 210 shown in FIG. 1.

In some implementations, the downhole monitoring system determines leaks continuously (for example, in real-time such as every second for an entire day). In this scenario, a leak is detected by a downhole monitoring system as soon as possible (for example, within seconds or minutes of a leak being detected).

In some implementations, the downhole monitoring system sends notifications to an engineer to notify the engineer of a detected leak and information about the detected leak. For example, in some cases, the downhole monitoring system sends a notification when the fluid level reduces below a threshold. In some examples, the engineer is notified to restore well integrity by eliminating the leak source.

Examples of determining fluid leaks are described with reference to FIGS. 6-8.

Figure 6:
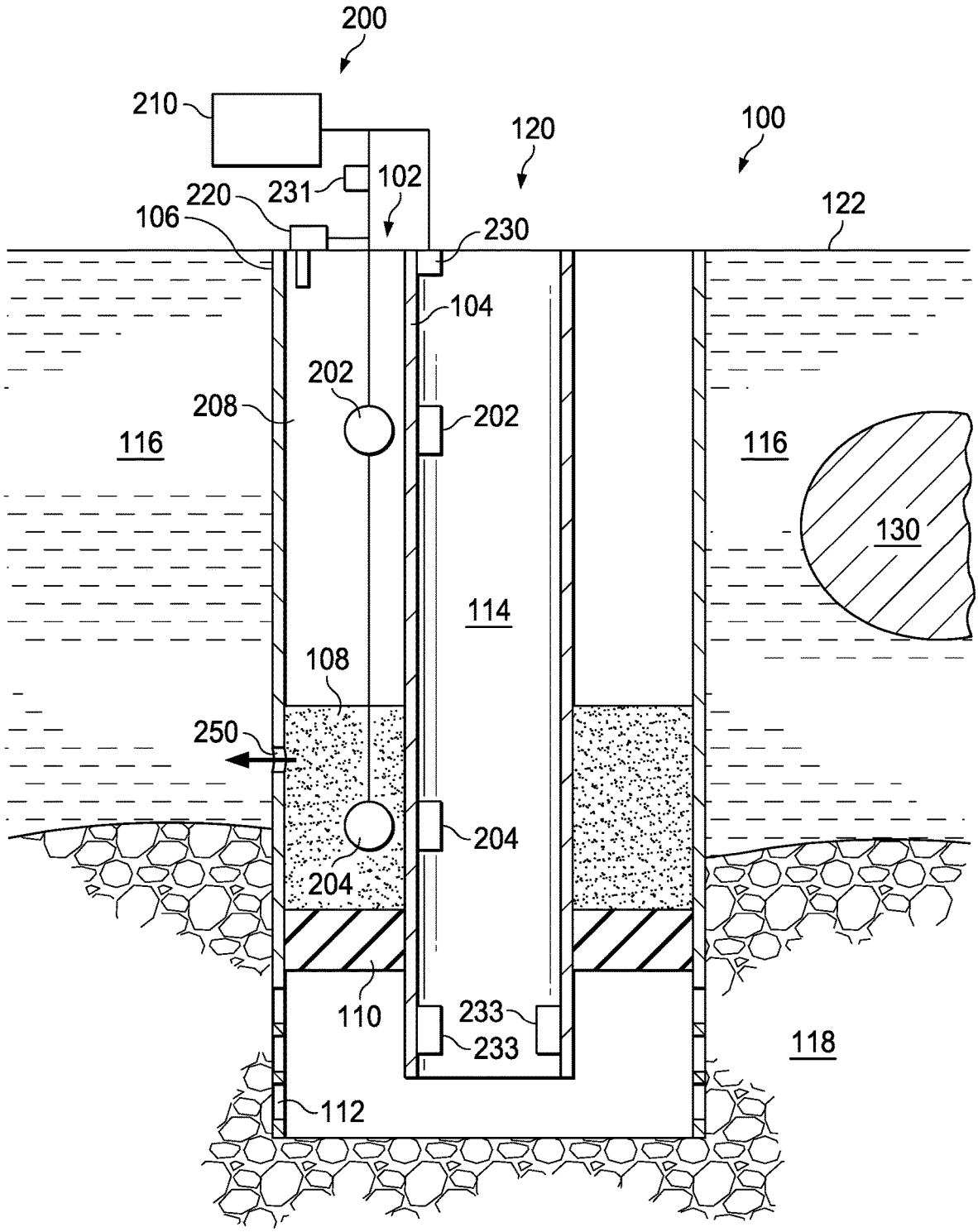
FIG. 6 is a schematic diagram of an example wellbore system with a casing leak.

FIG. 6 is a schematic diagram of an example wellbore system with a casing leak. In this scenario, fluid within the tubing casing annulus (typically completion fluid) leaks into the surrounding formation layers 116 via an opening 250. As shown in FIG. 6, the level of the fluid decreases because of the opening 250 and the top sensor assembly 202 eventually becomes no longer submerged in the fluid 108 (for example, sensor assembly 202 is surrounded by air 208 within the tubing casing annulus. In this case, both pressure sensors 231 and 202 measure a lower pressure than the lower sensor assembly 204.

Figure 7:
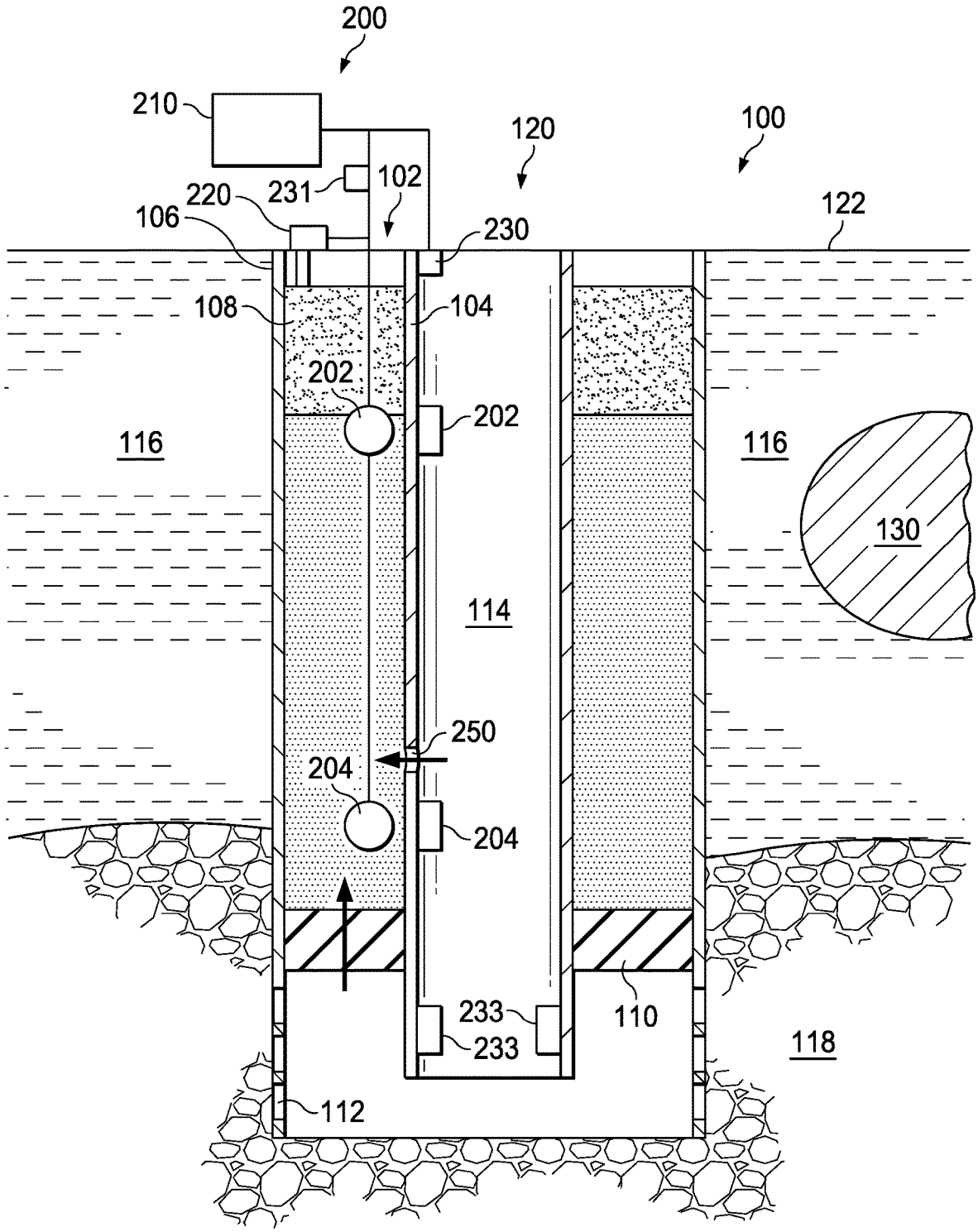
FIG. 7 is a schematic diagram of an example wellbore system with a packer and/or tubing leak.

FIG. 7 is a schematic diagram of an example wellbore system with a packer and/or tubing leak. In this scenario, reservoir fluid leaks through the tubing 104 and enters the tubing casing annulus 102 via the opening 250. In some cases, the reservoir fluid leaks through the packer 110 instead or in addition to the leak of the tubing.

Figure 8:
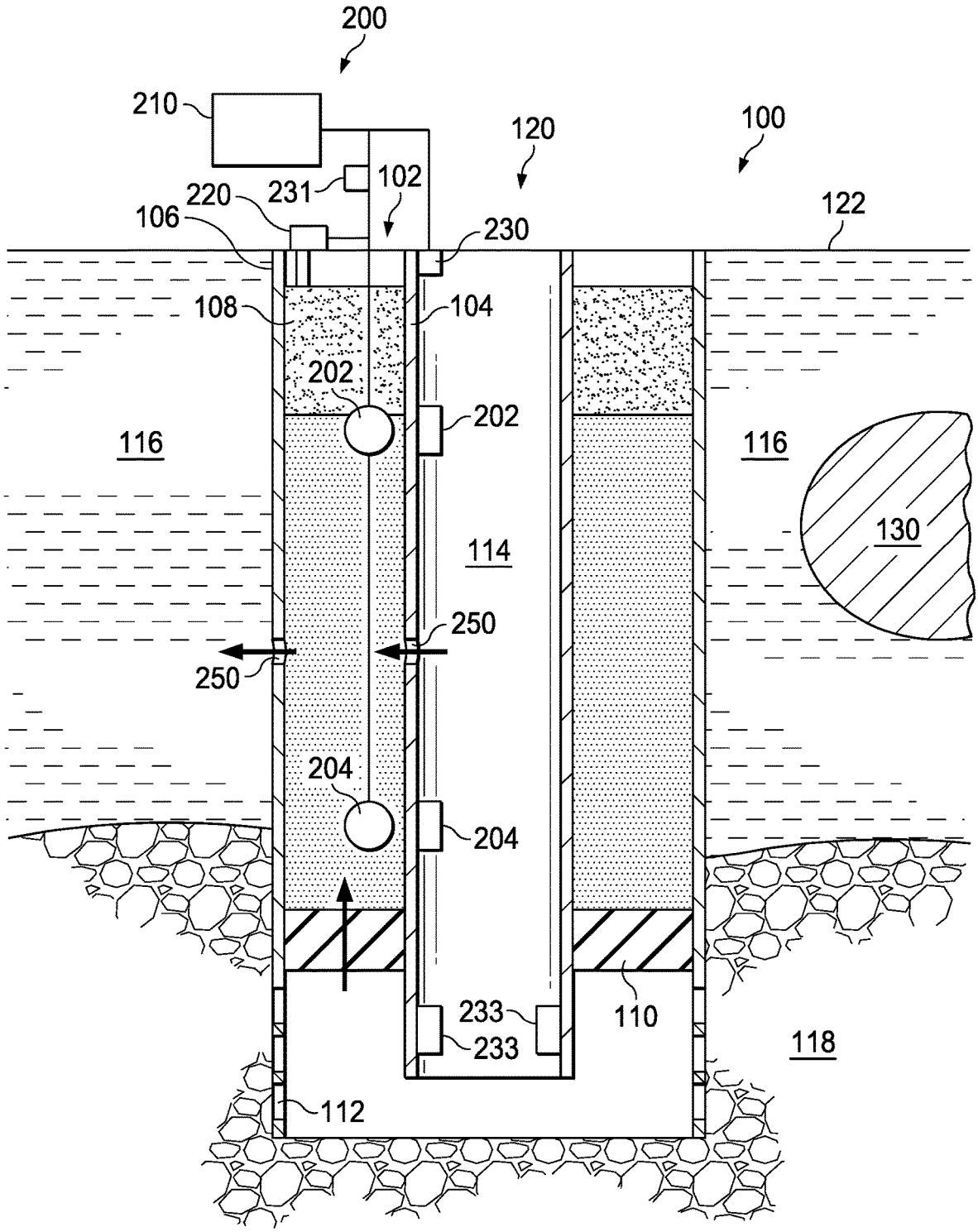
FIG. 8 is a schematic diagram of an example wellbore system with reservoir fluid cross flow.

FIG. 8 is a schematic diagram of an example wellbore system with reservoir fluid cross flow. In this scenario, reservoir fluid leaks through the tubing 104 and/or the packer 110 and enters the tubing casing annulus 102 while fluid within the tubing casing annulus 102 also leaks through the casing 106. In this example, the downhole monitoring system determines whether the surface tubing casing annulus pressure 231 is equal to shut-in wellhead pressure if a casing leak is not present or less than shut-in wellhead pressure if casing leak is present.

Figure 9:
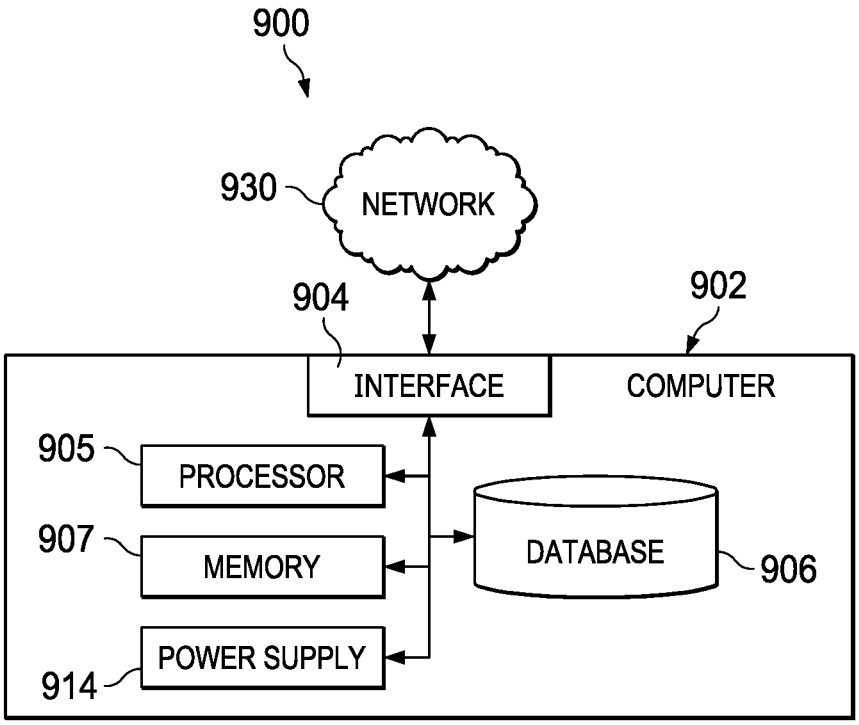
FIG. 9 is a schematic illustration of an example controller for a downhole monitoring system.

FIG. 9 is a block diagram of an example computer system 900 that can be used to provide computational functionalities associated with described algorithms, methods, functions, processes, flows, and procedures described in the present disclosure. In some implementations, the computer system 900 performs functions of the controller 210 of the downhole monitoring system 200.

The illustrated computer 902 is intended to encompass any computing device such as a server, a desktop computer, an embedded computer, a laptop/notebook computer, a wireless data port, a smart phone, a personal data assistant (PDA), a tablet computing device, or one or more processors within these devices, including physical instances, virtual instances, or both. The computer 902 can include input devices such as keypads, keyboards, and touch screens that can accept user information. Also, the computer 902 can include output devices that can convey information associated with the operation of the computer 902. The information can include digital data, visual data, audio information, or a combination of information. The information can be presented in a graphical user interface (UI) (or GUI). In some implementations, the inputs and outputs include display ports (such as DVI-I+2× display ports), USB 3.0, GbE ports, isolated DI/O, SATA-III (6.0 Gb/s) ports, mPCIe slots, a combination of these, or other ports. In instances of an edge gateway, the computer 902 can include a Smart Embedded Management Agent (SEMA), such as a built-in ADLINK SEMA 2.2, and a video sync technology, such as Quick Sync Video technology supported by ADLINK MSDK+. In some examples, the computer 902 can include the MXE-5400 Series processor-based fanless embedded computer by ADLINK, though the computer 902 can take other forms or include other components.

The computer 902 can serve in a role as a client, a network component, a server, a database, a persistency, or components of a computer system for performing the subject matter described in the present disclosure. The illustrated computer 902 is communicably coupled with a network 930. In some implementations, one or more components of the computer 902 can be configured to operate within different environments, including cloud-computing-based environments, local environments, global environments, and combinations of environments.

At a high level, the computer 902 is an electronic computing device operable to receive, transmit, process, store, and manage data and information associated with the described subject matter. According to some implementations, the computer 902 can also include, or be communicably coupled with, an application server, an email server, a web server, a caching server, a streaming data server, or a combination of servers.

The computer 902 can receive requests over network 930 from a client application (for example, executing on another computer 902). The computer 902 can respond to the received requests by processing the received requests using software applications. Requests can also be sent to the computer 902 from internal users (for example, from a command console), external (or third) parties, automated applications, entities, individuals, systems, and computers.

Each of the components of the computer 902 can communicate using a system bus. In some implementations, any or all of the components of the computer 902, including hardware or software components, can interface with each other or the interface 904 (or a combination of both), over the system bus. Interfaces can use an application programming interface (API), a service layer, or a combination of the API and service layer. The API can include specifications for routines, data structures, and object classes. The API can be either computer-language independent or dependent. The API can refer to a complete interface, a single function, or a set of APIs.

The service layer can provide software services to the computer 902 and other components (whether illustrated or not) that are communicably coupled to the computer 902. The functionality of the computer 902 can be accessible for all service consumers using this service layer. Software services, such as those provided by the service layer, can provide reusable, defined functionalities through a defined interface. For example, the interface can be software written in JAVA, C++, or a language providing data in extensible markup language (XML) format. While illustrated as an integrated component of the computer 902, in alternative implementations, the API or the service layer can be standalone components in relation to other components of the computer 902 and other components communicably coupled to the computer 902. Moreover, any or all parts of the API or the service layer can be implemented as child or submodules of another software module, enterprise application, or hardware module without departing from the scope of the present disclosure.

The computer 902 can include an interface 904. Although illustrated as a single interface 904 in FIG. 9, two or more interfaces 904 can be used according to particular needs, desires, or particular implementations of the computer 902 and the described functionality. The interface 904 can be used by the computer 902 for communicating with other systems that are connected to the network 930 (whether illustrated or not) in a distributed environment. Generally, the interface 904 can include, or be implemented using, logic encoded in software or hardware (or a combination of software and hardware) operable to communicate with the network 930. More specifically, the interface 904 can include software supporting one or more communication protocols associated with communications. As such, the network 930 or the interface's hardware can be operable to communicate physical signals within and outside of the illustrated computer 902.

The computer 902 includes a processor 905. Although illustrated as a single processor 905 in FIG. 9, two or more processors 905 can be used according to particular needs, desires, or particular implementations of the computer 902 and the described functionality. Generally, the processor 905 can execute instructions and can manipulate data to perform the operations of the computer 902, including operations using algorithms, methods, functions, processes, flows, and procedures as described in the present disclosure.

The computer 902 can also include a database 906 that can hold data for the computer 902 and other components connected to the network 930 (whether illustrated or not). For example, database 906 can be an in-memory, conventional, or a database storing data consistent with the present disclosure. In some implementations, database 906 can be a combination of two or more different database types (for example, hybrid in-memory and conventional databases) according to particular needs, desires, or particular implementations of the computer 902 and the described functionality. Although illustrated as a single database 906 in FIG. 9, two or more databases (of the same, different, or combination of types) can be used according to particular needs, desires, or particular implementations of the computer 902 and the described functionality. While database 906 is illustrated as an internal component of the computer 902, in alternative implementations, database 906 can be external to the computer 902.

The computer 902 also includes a memory 907 that can hold data for the computer 902 or a combination of components connected to the network 930 (whether illustrated or not). Memory 907 can store any data consistent with the present disclosure. In some implementations, memory 907 can be a combination of two or more different types of memory (for example, a combination of semiconductor and magnetic storage) according to particular needs, desires, or particular implementations of the computer 902 and the described functionality. Although illustrated as a single memory 907 in FIG. 9, two or more memories 907 (of the same, different, or combination of types) can be used according to particular needs, desires, or particular implementations of the computer 902 and the described functionality. While memory 907 is illustrated as an internal component of the computer 902, in alternative implementations, memory 907 can be external to the computer 902.

An application can be an algorithmic software engine providing functionality according to particular needs, desires, or particular implementations of the computer 902 and the described functionality. For example, an application can serve as one or more components, modules, or applications. Multiple applications can be implemented on the computer 902. Each application can be internal or external to the computer 902.

The computer 902 can also include a power supply 914. The power supply 914 can include a rechargeable or non-rechargeable battery that can be configured to be either user- or non-user-replaceable. In some implementations, the power supply 914 can include power-conversion and management circuits, including recharging, standby, and power management functionalities. In some implementations, the power-supply 914 can include a power plug to allow the computer 902 to be plugged into a wall socket or a power source to, for example, power the computer 902 or recharge a rechargeable battery.

There can be any number of computers 902 associated with, or external to, a computer system including computer 902, with each computer 902 communicating over network 930. Further, the terms "client," "user," and other appropriate terminology can be used interchangeably, as appropriate, without departing from the scope of the present disclosure. Moreover, the present disclosure contemplates that many users can use one computer 902 and one user can use multiple computers 902.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, Linux, Unix, Windows, Mac OS, Android, or iOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

A number of implementations of the systems and methods have been described. Nevertheless, it will be understood that various modifications may be made without departing from the spirit and scope of this disclosure. Accordingly, other implementations are within the scope of the following claims.

What is claimed is:

1. A method of determining a fluid leak of a tubing casing annulus of a well, the method comprising:

receiving pressure information and depth information from three or more pressure sensors in fluid communication with a fluid of the tubing casing annulus;

receiving at least three predetermined baseline pressure gradients of the fluid of the tubing casing annulus;

determining at least three current pressure gradients based on the pressure information and depth information of the three or more pressure sensors;

determining pressure gradient differences between the at least three predetermined baseline pressure gradients and the at least three current pressure gradients;

determining whether any of the pressure gradient differences are above a pressure gradient threshold, and responsive to determining that at least one of the pressure gradient differences is above the pressure threshold, determining a fluid level of the fluid within the tubing casing annulus based on the pressure gradient differences; and replacing the fluid within the tubing casing annulus when the fluid level is below a threshold.

2. The method of claim 1, wherein replacing the fluid within the tubing casing annulus comprises using a pump of the well to replace the fluid.

3. The method of claim 1, further comprising receiving temperature information and depth information from three or more temperature sensors in fluid communication with the fluid of the tubing casing annulus.

4. The method of claim 3, wherein the three or more temperature sensors are each collocated with the at least three pressure sensors.

5. The method of claim 4, further comprising determining at least three current temperature gradients based on the temperature information and depth information from the three or more temperature sensors.

6. The method of claim 5, further comprising determining temperature gradient differences between at least three baseline temperature gradients and the at least three current temperature gradients.

7. The method of claim 1, wherein determining the fluid level of the fluid within the tubing casing annulus comprises determining which pressure gradient differences are above the pressure gradient threshold and which pressure gradient differences are below the pressure gradient threshold.

8. The method of claim 1, further comprising determining a density of the fluid within the tubing casing annulus between each pair of the three or more pressure sensors based on the pressure information and depth information of the three or more pressure sensors.

9. The method of claim 1, further comprising receiving an indication that the well was in a flowing condition or a shut-in condition when the predetermined baseline pressure gradients were determined.

10. The method of claim 1, wherein receiving the at least three predetermined baseline pressure gradients comprises determining the at least three predetermined baseline pressure gradients.

11. A method of determining a fluid leak of a tubing casing annulus of a well, the method comprising:

receiving pressure information and depth information from three or more pressure sensors in fluid communication with a fluid of the tubing casing annulus;

receiving at least three baseline pressure gradients;

determining at least three current pressure gradients based on the pressure information and depth information of the three or more pressure sensors;

determining pressure gradient differences between the at least three baseline pressure gradients and the at least three current pressure gradients; and determining whether any of the pressure gradient differences are above a pressure gradient threshold, and responsive to determining that at least one of the pressure gradient differences is above the pressure threshold, determining a fluid level of the fluid within the tubing casing annulus based on the pressure gradient differences by determining that the fluid level is between a first pressure sensor of the three or more pressure sensors and a second pressure sensor of the three or more pressure sensors when the pressure gradient difference based on the first sensor and the second sensor is above the pressure gradient threshold.

12. A method of determining a fluid leak of a tubing casing annulus of a well, the method comprising:

receiving pressure information and depth information from three or more pressure sensors in fluid communication with a fluid of the tubing casing annulus;

receiving at least three baseline pressure gradients;

determining at least three current pressure gradients based on the pressure information and depth information of the three or more pressure sensors;

determining a density of the fluid within the tubing casing annulus between each pair of the three or more pressure sensors based on the pressure information and depth information of the three or more pressure sensors;

determining a fluid type of the fluid within the tubing casing annulus between each pair of the three or more pressure sensors based on the determined density of the fluid;

determining pressure gradient differences between the at least three baseline pressure gradients and the at least three current pressure gradients; and determining whether any of the pressure gradient differences are above a pressure gradient threshold, and responsive to determining that at least one of the pressure gradient differences is above the pressure threshold, determining a fluid level of the fluid within the tubing casing annulus based on the pressure gradient differences.

13. The method of claim 12, wherein determining the fluid type of the fluid within the tubing casing annulus comprises determining that the fluid is hydrocarbon when the determined density is above a density threshold and determining that the fluid is water and/or completion fluid when the determined density is below the density threshold.

14. The method of claim 13, further comprising determining a leak source of the tubing casing annulus.

15. The method of claim 14, wherein determining the leak source comprises determining whether the fluid level represents a full tubing casing annulus.

16. The method of claim 14, wherein determining the leak source comprises determining that a tubing leak and/or a packer leak and a casing leak is occurring when the tubing casing annulus is partially full and water and/or completion fluid is determined to be present within the tubing casing annulus based on the density.

17. The method of claim 14, wherein determining the leak source comprises determining that a casing leak is occurring when the tubing casing annulus is partially full and water and/or completion fluid is determined to not be present within the tubing casing annulus based on the density.

18. The method of claim 14, wherein determining the leak source comprises determining that a tubing leak and/or packer leak and a casing leak is occurring when the tubing casing annulus is full and water and/or completion fluid is determined to be present within the tubing casing annulus based on the density.

19. The method of claim 18, wherein determining the leak source comprises determining that a tubing leak and/or a packer leak and/or a surface leak is occurring when the tubing casing annulus is full and water and/or completion fluid is determined to be present within the tubing casing annulus and all of the pressure gradient differences are indicative of a pressurized annulus.

20. The method of claim 19, further comprising receiving results from a leak off test indicating whether the packer is leaking and determining the leak source is a packer leak or a tubing leak based on the results from the leak off test.

* * * * *